US010192725B2

(12) United States Patent
Jarrell

(10) Patent No.: US 10,192,725 B2
(45) Date of Patent: Jan. 29, 2019

(54) ATMOSPHERIC INTERFACE FOR ELECTRICALLY GROUNDED ELECTROSPRAY

(71) Applicant: Waters Technologies Corporation, Milford, MA (US)

(72) Inventor: Joseph A. Jarrell, Newton Highlands, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 15/102,910

(22) PCT Filed: Dec. 22, 2014

(86) PCT No.: PCT/US2014/071885
§ 371 (c)(1),
(2) Date: Jun. 9, 2016

(87) PCT Pub. No.: WO2015/100233
PCT Pub. Date: Jul. 2, 2015

(65) Prior Publication Data

US 2016/0307744 A1 Oct. 20, 2016

Related U.S. Application Data

(60) Provisional application No. 61/920,626, filed on Dec. 24, 2013.

(51) Int. Cl.
*H01J 49/00* (2006.01)
*H01J 49/04* (2006.01)
*H01J 49/16* (2006.01)

(52) U.S. Cl.
CPC ..... *H01J 49/0404* (2013.01); *H01J 49/044* (2013.01); *H01J 49/165* (2013.01)

(58) Field of Classification Search
CPC .. H01J 49/00; H01J 49/02; H01J 49/04; H01J 49/0404; H01J 49/0422; H01J 49/165; H01J 49/167
(Continued)

(56) References Cited

U.S. PATENT DOCUMENTS 3,937,954 A 2/1976 Fite
4,013,887 A 3/1977 Fite
(Continued)

FOREIGN PATENT DOCUMENTS

CN 1473348 A 2/2004
CN 101770924 A 7/2010
(Continued)

OTHER PUBLICATIONS

Extended European Search Report dated Aug. 28, 2017 in European Patent Application No. 14874104.4.
(Continued)

*Primary Examiner* — Jason McCormack
(74) *Attorney, Agent, or Firm* — Womble Bond Dickinson (US) LLP; Deborah M. Vernon; Heath T. Misley

(57) ABSTRACT

An interface for a mass spectrometer system is provided. The interface can include an inner ceramic tube fabricated from a first ceramic material and an outer tube fabricated from a second ceramic material surrounding the inner ceramic tube. The inner ceramic tube can have high electrical resistivity and high thermal conductivity and the intermediate ceramic tube can have an electrical resistivity that is at least an order of magnitude higher than the electrical resistivity of the first ceramic material and a thermal conductivity that is at least an order of magnitude higher than the thermal conductivity of the first ceramic material.

15 Claims, 28 Drawing Sheets

(58) Field of Classification Search
USPC ..... 250/281, 282, 283, 288
See application file for complete search history.

(56) References Cited

U.S. PATENT DOCUMENTS

| | | | | |
|---|---|---|---|---|
| 4,234,791 | A | 11/1980 | Enke et al. | |
| 4,390,784 | A | 6/1983 | Browning et al. | |
| 4,542,293 | A | 9/1985 | Fenn et al. | |
| 4,861,988 | A | 8/1989 | Henion et al. | |
| 5,015,845 | A | 5/1991 | Allen et al. | |
| 5,304,798 | A | 4/1994 | Tomany et al. | |
| 5,306,910 | A | 4/1994 | Jarrell et al. | |
| 5,581,080 | A * | 12/1996 | Fenn | B01D 59/44 250/282 |
| 5,608,217 | A | 3/1997 | Franzen et al. | |
| 5,736,740 | A | 4/1998 | Franzen | |
| 5,838,003 | A | 11/1998 | Bertsch et al. | |
| 5,847,386 | A | 12/1998 | Thomson et al. | |
| 5,965,883 | A | 10/1999 | Lee et al. | |
| 6,359,275 | B1 | 3/2002 | Bertsch et al. | |
| 6,396,057 | B1 | 5/2002 | Jarrell et al. | |
| 6,486,469 | B1 | 11/2002 | Fischer et al. | |
| 6,576,897 | B1 | 6/2003 | Steiner et al. | |
| 6,593,568 | B1 * | 7/2003 | Whitehouse | H01J 49/0404 250/282 |
| 6,803,585 | B2 | 10/2004 | Glukhoy | |
| 6,812,453 | B2 | 11/2004 | Bateman et al. | |
| 6,943,347 | B1 | 9/2005 | Willoughby et al. | |
| 6,998,605 | B1 | 2/2006 | Frazer et al. | |
| 7,041,966 | B2 | 5/2006 | Frazer et al. | |
| 7,060,987 | B2 | 6/2006 | Lee | |
| 7,081,618 | B2 | 7/2006 | Laprade | |
| 7,154,086 | B2 | 12/2006 | Laprade | |
| 7,208,726 | B2 * | 4/2007 | Hidalgo | H01J 49/401 250/281 |
| 7,259,368 | B2 | 8/2007 | Frazer et al. | |
| 7,368,708 | B2 | 5/2008 | Fischer | |
| 7,547,891 | B2 | 6/2009 | Mordehai et al. | |
| 7,705,296 | B2 | 4/2010 | Wu | |
| 7,943,901 | B2 | 5/2011 | Wu | |
| 7,952,709 | B2 | 5/2011 | Feilders et al. | |
| 8,084,732 | B2 | 12/2011 | Laprade | |
| 8,314,383 | B2 | 11/2012 | Wu | |
| 8,552,366 | B2 | 10/2013 | Hoyes | |
| 2003/0034452 | A1 | 2/2003 | Fischer et al. | |
| 2003/0234369 | A1 | 12/2003 | Glukhoy | |
| 2004/0238755 | A1 | 12/2004 | Lee | |
| 2006/0108539 | A1 * | 5/2006 | Franzen | G01N 27/68 250/423 P |
| 2007/0278396 | A1 | 12/2007 | Wu | |
| 2008/0121797 | A1 | 5/2008 | Wu | |
| 2008/0142698 | A1 | 6/2008 | Atherton et al. | |
| 2008/0152509 | A1 | 6/2008 | Chang et al. | |
| 2008/0197275 | A1 | 8/2008 | Mordehai et al. | |
| 2010/0225909 | A1 | 9/2010 | Feilders et al. | |
| 2011/0183431 | A1 | 7/2011 | Covey | |
| 2011/0210244 | A1 | 9/2011 | Wu | |
| 2011/0260048 | A1 * | 10/2011 | Wouters | H01J 49/0404 250/282 |
| 2012/0153140 | A1 | 6/2012 | Makarov | |
| 2012/0199736 | A1 | 8/2012 | Danel et al. | |
| 2012/0298853 | A1 | 11/2012 | Kurulugama | |
| 2013/0009053 | A1 | 1/2013 | Wu | |
| 2013/0214154 | A1 | 8/2013 | McEwen et al. | |
| 2014/0326870 | A1 | 11/2014 | Makarov | |

FOREIGN PATENT DOCUMENTS

| | | | |
|---|---|---|---|
| CN | 102568995 | A | 7/2012 |
| CN | 105828954 | A | 8/2016 |
| EP | 1225616 | A2 | 7/2002 |
| JP | 2017500718 | A | 1/2017 |
| WO | 2011133817 | A1 | 10/2011 |
| WO | 2012031082 | A2 | 5/2012 |
| WO | 2014194172 | A2 | 12/2014 |
| WO | 2015100233 | A2 | 7/2015 |

OTHER PUBLICATIONS

Response to Office Action filed Sep. 8, 2017 in Japanese Patent Application No. 2016-542660, and machine English translation thereof.

Notice of Allowance dated Sep. 19, 2017 in Japanese Patent Application No. 2016-542660.

Response to Office Action filed Sep. 20, 2017 in Chinese Patent Application No. 201480070657.3, and machine English translation thereof.

Office Action dated May 18, 2017 in Chinese Patent Application No. 201480070657.3, and English translation thereof.

PCT Notification of Transmittal of the International Search Report and the Written Opinion of the International Searching Authority; International Search Report; and Written Opinion, dated Aug. 12, 2015 in International Application No. PCT/US2014/071885.

PCT Notification Concerning Transmittal of International Preliminary Report on Patentability; International Preliminary Report on Patentability; and Written Opinion of the International Searching Authority, dated Jul. 7, 2016 in International Application No. PCT/US2014/071885.

"NKG Develops Electrically Conductive Aluminum Nitride," published Jan. 27, 2004, retrieved from URL: <http://www.azom.com/news.aspx?newsID=952>.

"Watlow ULTRAMIC Advanced Ceramic Heaters," Watlow Electric Manufacturing Company, 2011.

Office Action dated Jun. 13, 2017 in Japanese Patent Application No. 2016-542660, and English translation thereof.

Carrico et al., "Simple Electrode Design for Ion Mobility Spectrometer," J. Phys. E: Sc. Instrum., vol. 16 (1983) Great Britain, 1058-1062.

* cited by examiner

ATMOSPHERIC INTERFACE FOR ELECTRICALLY GROUNDED ELECTROSPRAY

CROSS REFERENCE TO RELATED APPLICATIONS

This application is a U.S. National Stage of International Application No. PCT/US2014/071885, filed Dec. 22, 2014, which claims priority to and the benefit of U.S. Provisional Application No. 61/920,626, filed Dec. 24, 2013, the contents and teachings of all of which are hereby expressly incorporated by reference in their entirety.

BACKGROUND

The present embodiments relate generally to an interface for introducing ions into a mass spectrometer, and in particular to an interface that allows both an electrospray nebulizer and its associated mass spectrometer to be at or near electrical ground.

Mass spectrometers are instruments that measure the mass-to-charge ratio of ions. There are many different types of mass spectrometers, including, for example, time-of-flight mass spectrometers, quadrupole mass spectrometers, magnetic sector mass spectrometers, sector quadrupole mass spectrometers, ion trap mass spectrometers, Fourier transform ion cyclotron resonance mass spectrometers, Kingdon trap-based mass spectrometers sold commercially as Orbitrap mass spectrometers, and tandem mass spectrometers. The term "mass spectrometer" is used herein to refer to any of these mass spectrometers, as well as other spectrometers that measure the mass-to-charge ratio of ions.

Mass spectrometers are often coupled with liquid chromatographs, including high performance liquid chromatographs, to analyze materials. For example, a sample of the material may first be separated by a liquid chromatograph into its constituents. The resulting liquid effluent may then be coupled to a mass spectrometer via an electrospray interface. The electrospray interface is used to introduce the sample into the mass spectrometer in the form of charged ions, so that the molecules in the sample can be separated according to their mass-to-charge ratio. In addition to liquid chromatographs, mass spectrometers may also be coupled using an electrospray nebulizer to other sources such as capillary electrophoresis, supercritical fluid chromatography and ion chromatography sources.

Several issued U.S. patents address the problem of interfacing an ion source to a mass spectrometer, including U.S. Pat. No. 4,542,293 to Fenn et al., which discloses an interface from an electrospray ion source to the inlet of a mass spectrometer; U.S. Pat. No. 5,304,798 to Tomany et al., which discloses a housing for converting an electrospray into a desolvated stream for analysis; U.S. Pat. No. 5,736,740 to Franzen, which discloses a device for the transport of ions through a capillary against a potential difference; and U.S. Pat. No. 6,396,057 to Jarrell et al., which discloses an apparatus for coupling the output from a liquid phase separation apparatus to a mass spectrometer. U.S. Pat. No. 4,013,887 discloses a method for separating AC and DC electric fields using homogeneous materials of moderate to high resistivity. Each of these patents is incorporated by reference herein in its entirety.

SUMMARY

The embodiments of the atmospheric interface disclosed herein allow both the electrospray and the exterior of the mass spectrometer, except for parts of the electrospray interface itself, to be at or near ground, thus minimizing the potential for injuries due to accidental contact with a high voltage component.

In an embodiment, the interface for a mass spectrometer system includes a front piece and an end piece, an inner ceramic tube having an inner bore extending from the front piece to the end piece, an intermediate ceramic tube surrounding the inner ceramic tube and in thermal contact with the inner ceramic tube, and a high voltage DC power supply electrically connected at a first polarity to the front piece and at a second polarity to the end piece. The inner bore of the inner ceramic tube includes an entrance orifice and an exit orifice. The inner ceramic tube is fabricated from a first ceramic material that has high electrical resistivity and high thermal conductivity and the intermediate ceramic tube is fabricated from a ceramic material that has, at room temperature, an electrical resistivity that is at least an order of magnitude higher than the electrical resistivity of the first ceramic material and a thermal conductivity that is typically at least as high as, and usually preferably higher than, the thermal conductivity of the first ceramic material.

In another embodiment, the interface for a mass spectrometer system has an entrance orifice at a front piece, a first ceramic tube fabricated from a first ceramic material extending from the front piece to an end piece and an inner bore in the first ceramic tube extending from the entrance orifice to an exit orifice in the end piece. It also has a second ceramic tube fabricated from a second ceramic material surrounding and holding the first ceramic tube at its center, and a heater in thermal contact with the second ceramic tube. The first ceramic material is characterized by a first electrical resistivity and by a first thermal conductivity. The second ceramic material is characterized by a second electrical resistivity and by a second thermal conductivity. At room temperature, the second electrical resistivity is higher than the first electrical resistivity by at least two orders of magnitude and a thermal conductivity that is typically at least as high as, and usually preferably higher than, the thermal conductivity of the first ceramic material In a further embodiment, the interface for a mass spectrometer includes a first ceramic tube fabricated from a first ceramic material within a second ceramic tube fabricated from a second ceramic material. There is an inner bore in the first ceramic tube extending from an entrance orifice to an exit orifice, and an optional heater for heating the second ceramic tube. The electrical resistivity of the second ceramic material is at least two orders of magnitude higher than the electrical resistivity of the first ceramic material from room temperature to 225° C. Also, the thermal conductivity of the second ceramic material is typically at least as high as, and usually preferably higher than, the thermal conductivity of the first ceramic material from room temperature to 225° C.

Another embodiment s a mass spectrometer system comprising an interface mounted at an entrance to a first stage of a mass spectrometer that has a second stage with an ion guide attached to the first stage, and a third stage with a mass analyzer attached to the second stage. The interface has a front piece with an entrance orifice and an end piece with an exit orifice. It has a first ceramic tube fabricated from a first ceramic material extending from the front piece to an end piece, and an inner bore inside the first ceramic tube extending from the entrance orifice to an exit orifice in the end piece. It also has a second ceramic tube fabricated from a second ceramic material enclosing the first ceramic tube. At room temperature, the electrical resistivity of the second ceramic material is higher than the electrical resistivity of the first ceramic material by at least two orders of magnitude and the thermal conductivity of the second ceramic material is typically at least as high as, and usually preferably higher than, the thermal conductivity of the first ceramic material.

Another embodiment is an interface for a mass spectrometer. The interface has a front cone with an entrance orifice and an end piece with an exit orifice. It has a tube of alternating ceramic washers and metal washers extending from the entrance orifice to the exit orifice that form an inner bore extending from the entrance orifice to the exit orifice. It also has a high voltage power supply maintaining a potential difference between the potential of the front cone and the end piece that has an absolute value of about 2-5 kV. The high voltage power supply distributes a cascading potential voltage to each of the metal washers ranging from at or near the 2-5 kV at the front cone to at or near ground at the end piece via a network of resistors. It also has an RF power supply providing an RF signal to each of the metal washers. The RF signal applied to each metal washer is 180° out-of-phase with the RF signal applied to its neighboring washers. The ceramic washers are made of a ceramic material that has an electrical resistivity above about $10^7$ Ω-cm and a thermal conductivity of above about 1 W/m-K.

Another embodiment is an interface for a mass spectrometer that has a front piece with an entrance orifice and an end piece with an exit orifice. It also has an inner ceramic tube with an inner bore. The inner bore extends from the entrance orifice at the front cone to the exit orifice at the end piece. The inner ceramic tube is fabricated from a first ceramic material that has high electrical resistivity and high thermal conductivity. Ring electrodes encircle the inner ceramic tube along its length. A high voltage DC power supply applies a cascading DC voltage to each of the ring electrodes. The interface also has an intermediate ceramic tube made of a second ceramic material surrounding and in thermal contact with the inner ceramic tube. The intermediate ceramic tube has an embedded heater. The room temperature resistivity of the second ceramic material is at least an order of magnitude higher than the room temperature electrical resistivity of the first ceramic material. Also, at room temperature the thermal conductivity of the second ceramic material is typically at least as high as, and usually preferably higher than, the thermal conductivity of the first ceramic Another embodiment is an interface for a mass spectrometer that has a front cone with an entrance orifice and an end piece having an exit orifice. It also has an inner ceramic tube with an inner bore. The inner bore extends from the entrance orifice at the front cone to the exit orifice at the end piece. The inner ceramic tube is fabricated from a first ceramic material that has high electrical resistivity and high thermal conductivity. Ring electrodes encircle the inner ceramic tube along its length. A high voltage DC power supply applies a cascading DC voltage to each of the ring electrodes. A first intermediate ceramic tube that is made of a second ceramic material surrounds and is in thermal contact with a first portion of the inner ceramic tube. A second intermediate ceramic tube that is made of the second ceramic material surrounds and is in thermal contact with a second portion of the inner ceramic tube. The first intermediate ceramic tube incorporates a first embedded heater, and the second intermediate ceramic tube incorporates a second embedded heater. The first embedded heater and the second embedded heater are controlled independently of each other. At room temperature, the second ceramic material has an electrical resistivity that is at least an order of magnitude higher than the electrical resistivity of the first ceramic material and a thermal conductivity that is is typically at least as high as, and usually preferably higher than, the thermal conductivity of the first ceramic material Another embodiment is an interface with a front cone and an end piece. It has an inner ceramic tube with an inner bore that extends from the front cone to the end piece. The inner bore has an entrance orifice and an exit orifice. The inner ceramic tube is fabricated from a first ceramic material that has high electrical resistivity and high thermal conductivity. It has a high voltage DC power supply electrically connected at a first polarity to the front cone and to a front electrode in electrical and thermal contact with the front cone, and at a second polarity opposite to the first polarity to the end piece. It also has an intermediate ceramic tube made of a second ceramic material surrounding and in thermal contact with the inner ceramic tube. At room temperature, the second ceramic material has an electrical resistivity that is at least an order of magnitude higher than the electrical resistivity of the first ceramic material, and a thermal conductivity that is is typically at least as high as, and usually preferably higher than, the thermal conductivity of the first ceramic material Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

The disclosure herein of embodiments of an interface for an electrically grounded electrospray should not be limited to the particular embodiments described herein. Instead, the disclosure may be applied to any interface to a mass spectrometer or other instrument comprising certain of the features described herein and recited in the claims.

Figure 1:
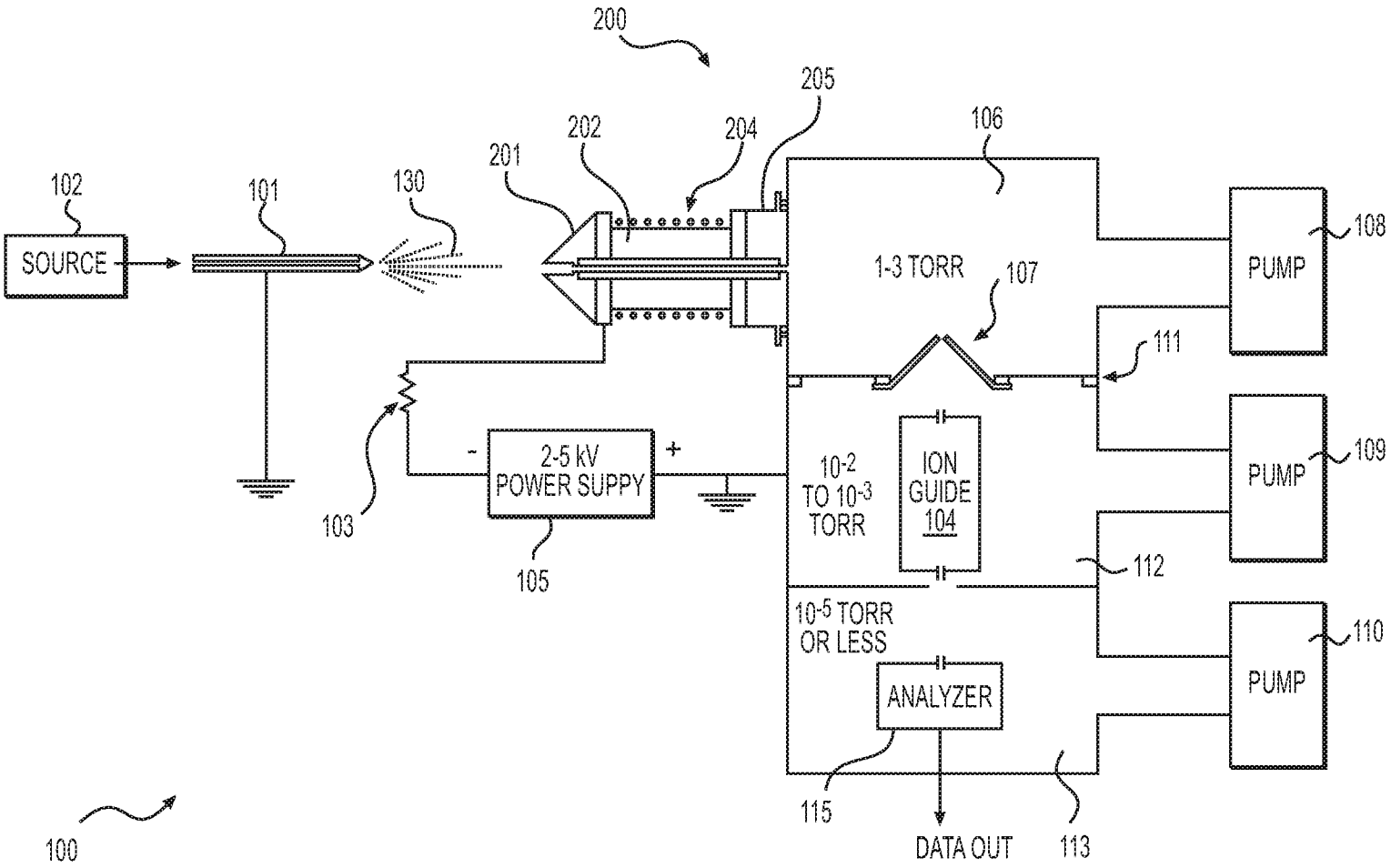
FIG. 1 is a block diagram showing a liquid chromatograph coupled to a mass spectrometer via an electrospray nebulizer.

FIG. 1 is a schematic diagram of a mass spectrometer system embodying an electrically grounded electrospray. FIG. 1 shows charged droplets, clusters and ions 130 flowing out of an electrospray nebulizer 101 into the atmospheric region between the output of nebulizer 101 and an embodiment of the electrically grounded electrospray interface 200. Electrospray interface 200 is mounted to the entrance to a mass spectrometer system 100. The tip of the nebulizer 101 is at or near ground. In FIG. 1, nebulizer 101 is oriented axially with respect to the central axis of electrospray interface 200, but in other systems nebulizer 101 may be oriented at another angle with respect to the axis of the electrospray interface. To generate positively charged droplets and ions in the electrospray, the front cone 201 of electrospray interface 200 may be held at a high negative potential, for example in the range of −2 kV to −5 kV. The stress imposed by the electric field produced by the difference in electrical potential between the output of nebulizer 101 and front cone 201 causes the liquid flowing out of nebulizer 101 to break into an electrospray of highly positively charged droplets, clusters and ions.

The system may also be used to generate negatively charged droplets, clusters and ions instead of generating positively charged droplets, clusters and ions. To generate negatively charged droplets, clusters and ions, front cone 201 may be held at a high positive potential with respect to ground, for example in the range of +2 kV to +5 kV. In that case, the stress imposed by the electric field causes the liquid flowing out of nebulizer 101 to break into an electrospray of highly negatively charged droplets, clusters and ions. Although for convenience and consistency, the mass spectrometer system is described herein as generating and manipulating positively charged droplets, clusters and ions, this description may be applied to a system for generating and manipulating negatively charged droplets, clusters and ions by reversing the polarity of the voltage applied between the nebulizer and the front cone of the electrospray interface. Typically, the polarity of the various other voltages applied to elements of mass spectrometer 100 will need to be simultaneously reversed.

Because the chamber in the first stage 106 of the mass spectrometer is maintained at a low pressure, for example at a pressure below 50 Torr, preferably in the range of 1-10 Torr, the pressure differential between the atmospheric pressure region at the output of nebulizer 101 and the low pressure in the chamber in the first stage of the mass spectrometer causes the gas in the atmospheric region to flow into front cone 201 of interface 200, through an inner passageway or bore 211 (described below) in interlace 200 and into the first chamber 106 of mass spectrometer system 100. This flow of gas carries along electrosprayed droplets, clusters and ions 130 such that at least some of the droplets, clusters and ions pass through an orifice in front cone 201 and into the inner bore 211 of electrospray interface 201 which leads to the first low pressure chamber 106 of mass spectrometer system 100.

After the ions enter chamber 106, they are directed by electric fields and gas flow within the mass spectrometer system to pass through skimmer 107 and ion guide 104 and enter mass analyzer 115 for analysis. Pumps 108, 109 and 110 are used to maintain the desired pressures in chambers 106, 112 and 113. Electrically insulating rings 111 are used to insulate skimmer 107 from the walls of chambers 106 and 112 and to insulate chamber 106 from chamber 112.

Countercurrent gas flow is often used in atmospheric ion interfaces to aid in droplet desolvation and to help keep the ion sampling orifice clean. For example, FIG. 1 in U.S. Pat. No. 5,581,080, which is incorporated by reference in this specification, depicts the use of such a drying gas.

Figure 2:
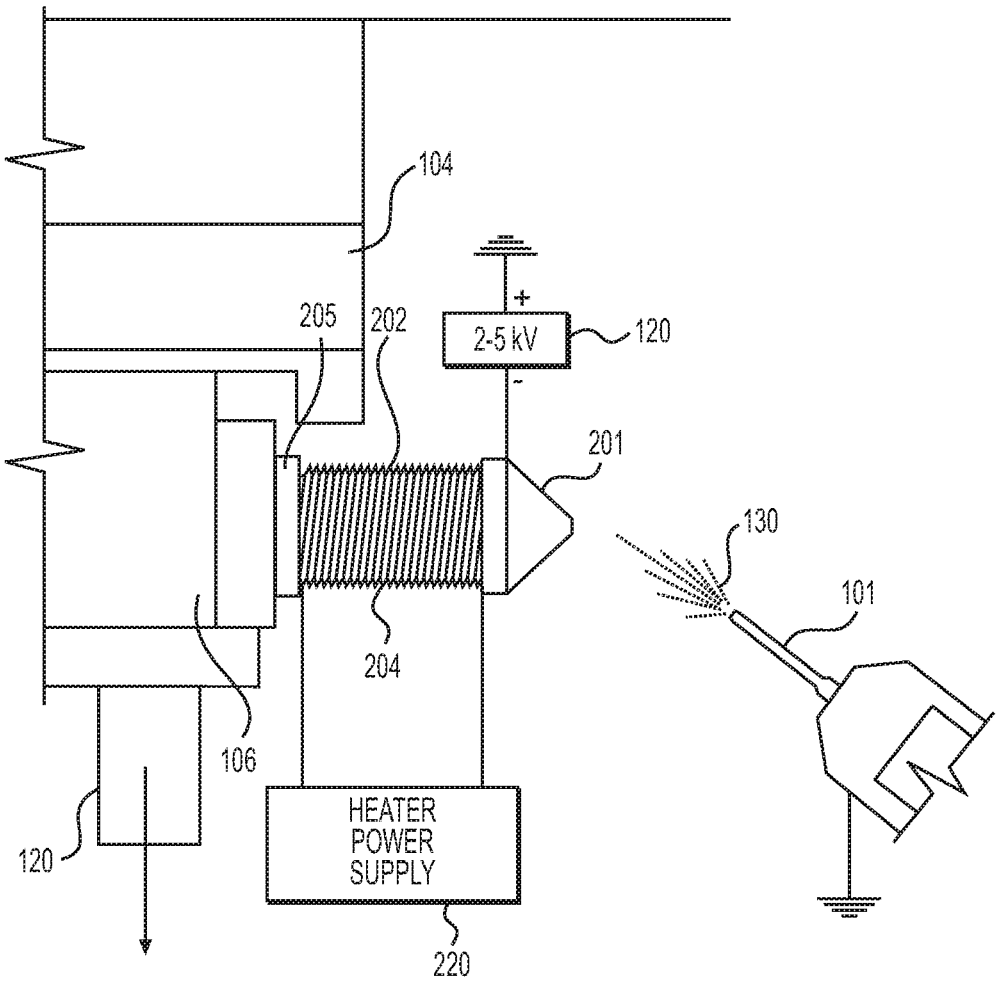
FIG. 2 is a schematic diagram showing a top close-up view of an embodiment of an electrospray interface mounted on a mass spectrometer system.

FIG. 2 is a schematic diagram showing a top close-up view of an electrospray interface mounted on a mass spectrometer system. Nebulizer 101 is held at ground (as shown) or near ground. In this example, nebulizer 101 is oriented at an angle to the central axis of the electrospray interface. Droplets, clusters and ions 130 are generally positively charged when front cone 201 is held at a high negative potential such as −2 kV to −5 kV with respect to the nebulizer, as described above. Negatively charged droplets, clusters and ions 130 are produced when front cone 201 is held at a high positive potential such as +2 kV to +5 kV with respect to front cone 201. Because the chambers 106, 104, and 113 of mass spectrometer system 100 are held at or near ground, there is a potential difference of about 2 kV to about 5 kV between front cone 201 of electrospray interface 200 and end piece 205. As discussed below, this potential difference generates an electric field that produces a force on the charged droplets, clusters and ions that opposes the flow of those droplets, clusters and ions into chamber 106 of mass spectrometer system 100. Thus the flow of neutral gas molecules must be sufficient to overcome this opposing force and allow the droplets, clusters and ions to enter chamber 106. Accordingly, the pressure in chamber 106 should be low enough to allow the flow of neutral gas molecules to overcome the electric field across electrospray interface 200 and entrain charged droplets, cluster and ions through bore 211 and into chamber 106.

Heater coil 204 and heater power supply 220 heat bore 211 in electrospray interface 200 so as to desolvate the droplets and clusters that enter bore 211, such that essentially only ions and neutral particles emerge from the opposite end of electrospray interface and enter into chamber 106. Desolvation of droplets and clusters is described in U.S. Pat. No. 5,304,798 to Tomany et al., which is incorporated by reference above. Pump 108 evacuates almost all of the neutral particles.

Figure 3A:
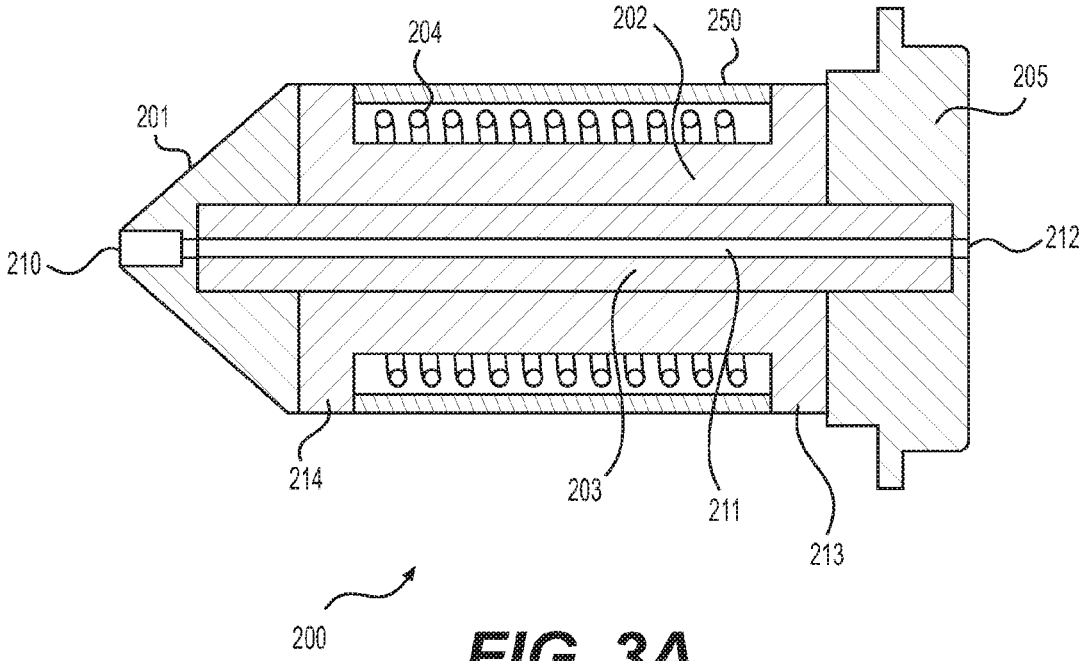
FIG. 3A is a cross-section of an embodiment of an electrospray interface.

FIG. 3A is a cross-section of an embodiment of an electrospray interface to a mass spectrometer. In the embodiment shown in FIG. 3A, electrospray interface 200 has a front cone 201 that has an entrance orifice 210 positioned to receive charged particles flowing from electrospray nebulizer 101. A first ceramic tube 203 has an inner bore 211 extending from orifice 210 to and through end piece 205 to exit orifice 212 in end piece 205. The front cone 201 and the end piece 205 may be fabricated from stainless steel or from other similarly electrically and thermally conductive and corrosion-resistant materials.

As shown in FIG. 3A, first ceramic tube 203 extends between front cone 201 and end piece 205. First ceramic tube 203 is fabricated from a first ceramic material. It is held in the center of a second ceramic tube 202 fabricated from a second ceramic material, as also shown in FIG. 3A. In some embodiments, a heater coil 204 is wound around second ceramic tube 202. Heater coil 204 can be used to maintain inner bore 211 at a temperature sufficient to desolvate the droplets and clusters entering front cone 201 so that individual ions are produced exiting end piece 205 through exit orifice 212 for analysis by the mass spectrometer. The inner bore may be held at a temperature in the range of 65° C. to 225° C., for example in the range from 100° C. to 180° C.

Figure 3B:
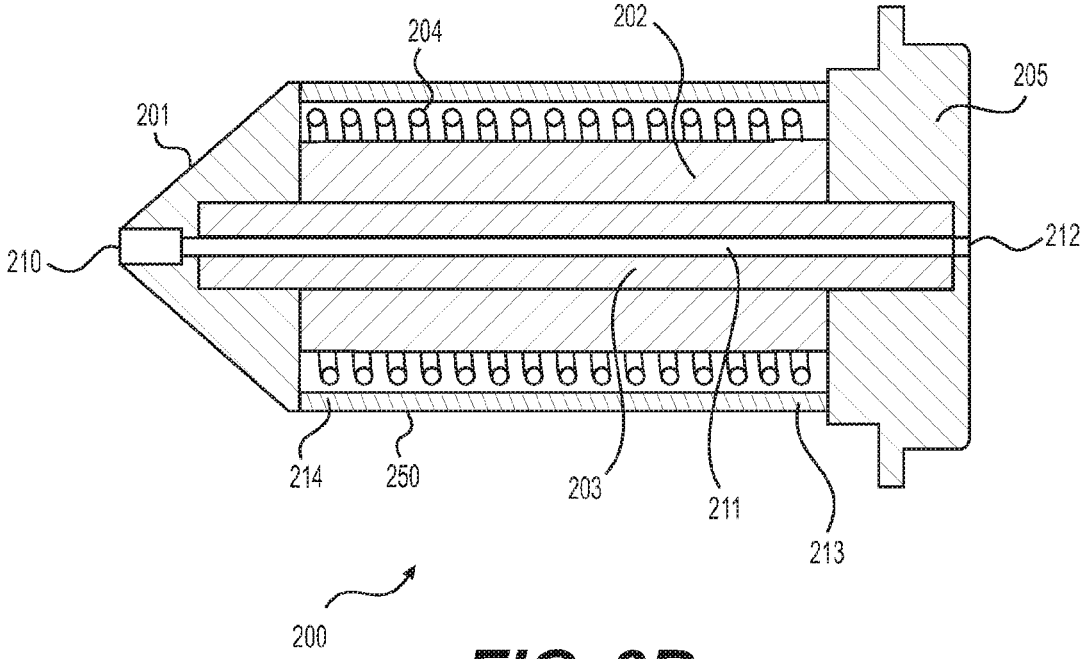
FIG. 3B is a cross-section of another embodiment of an electrospray interface.
Figure 3C:
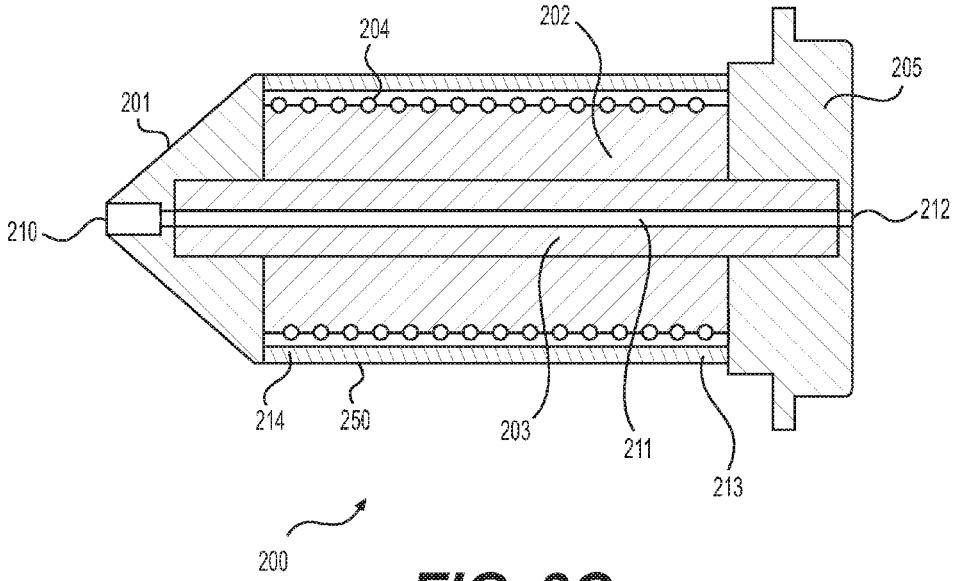
FIG. 3C is a cross-section of another embodiment of an electrospray interface.

In the example shown in FIG. 3A, second ceramic tube 202 has large diameter disks at its ends, such that, together, second ceramic tube 202 and disks 213 and 214 at its ends form a bobbin around which heater coil 204 may be wound. However, as shown in FIG. 3B, heater coil 204 may be wound around second ceramic tube 202 without disks 213 and 214. Alternatively, heater coil 204 could be wound around grooves in ceramic tube 202, as shown in FIG. 3C.

Second ceramic tube 202 may also be fabricated with embedded heater elements 240, instead of having a separate heater coil wound around second ceramic tube 202. An example of this embodiment is shown schematically in FIG. 3D. For example, Watlow Electric Manufacturing Company produces AlN (aluminum nitride) ceramic heaters with thermally matched embedded heating elements, which may be used as a combination of the second ceramic tube and the heating element.

Figure 3D:
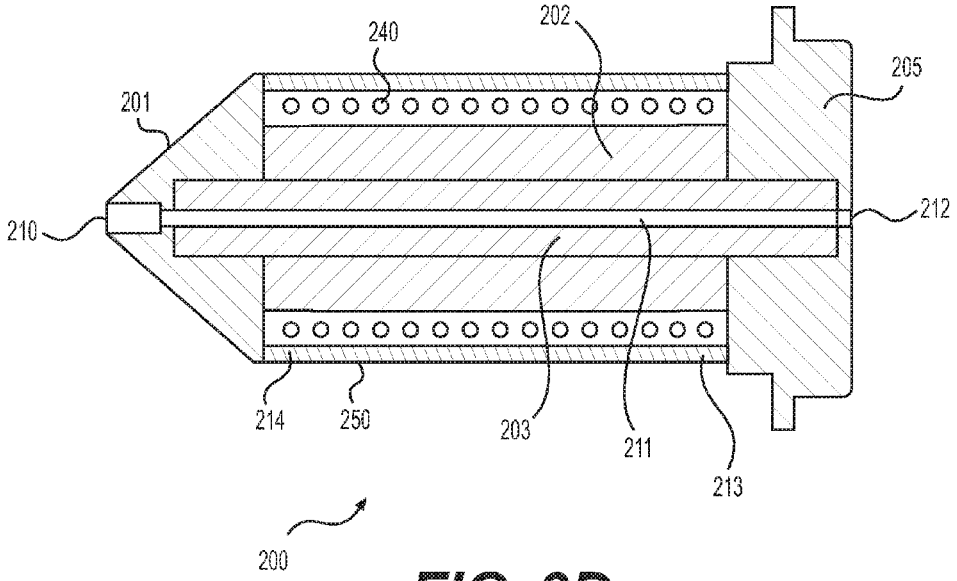
FIG. 3D is a cross-section of another embodiment of an electrospray interface.
Figure 3E:
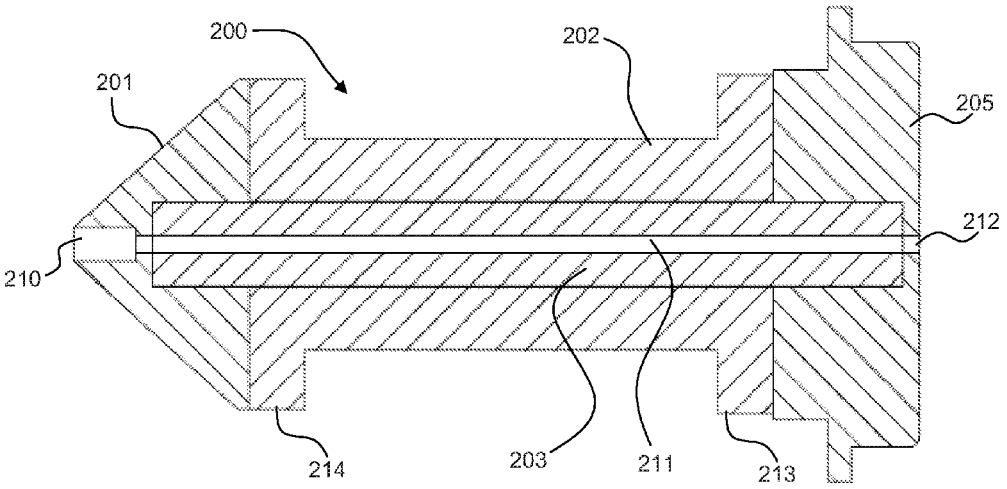
FIG. 3E is a cross-section of another embodiment of an electrospray interface.
Figure 3F:
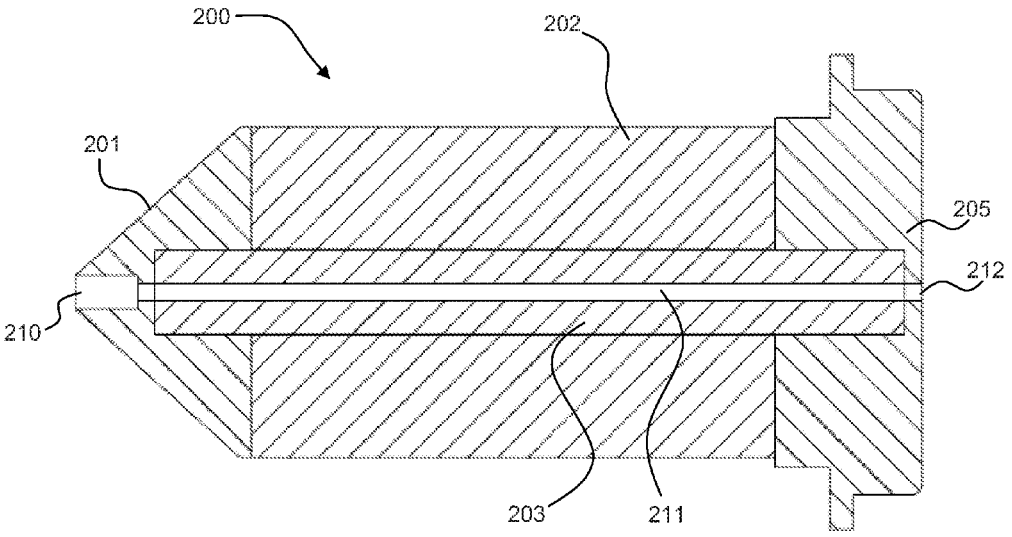
FIG. 3F is a cross-section of another embodiment of an electrospray interface.

Optionally, in any of the embodiments described above, heater coil 204 or heating element 240 may be enclosed by a protective electrically and thermally insulating cylindrical cover 250, as shown in FIGS. 3A-3D and 4A-4D. For example, cylindrical cover 250 may be a porcelain clamshell dimensioned to close over heater coil 204 or over heating element 240. In other embodiments, the protective electrically and thermally insulating cylindrical cover 250 can be omitted, e.g., as shown in FIGS. 3E and 3F. As shown in FIG. 3F, the second ceramic tube 202 can have a circumference substantially the same as the front cone 201 along its length.

Figure 3G:
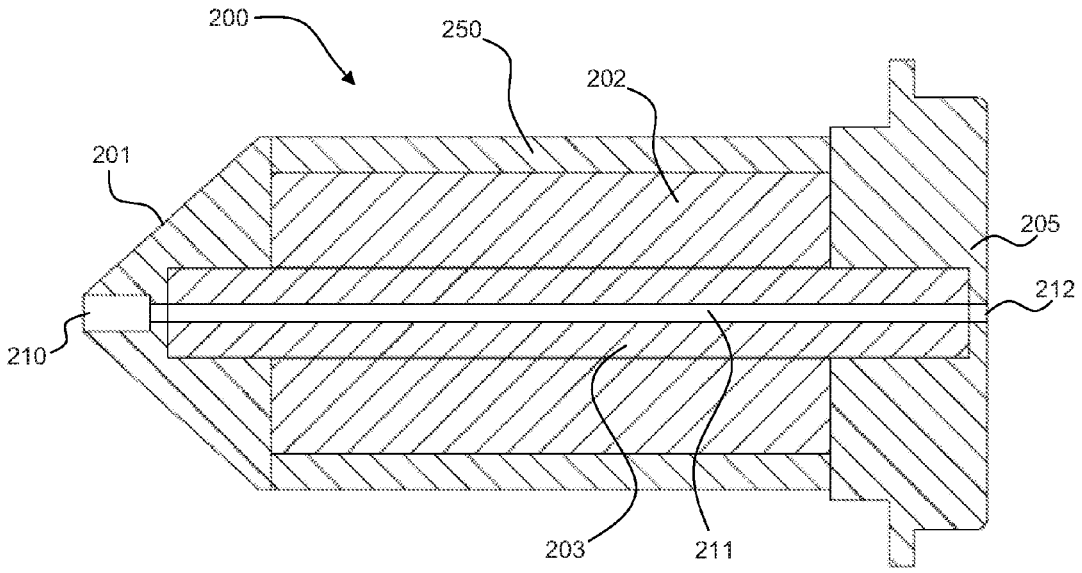
FIG. 3G is a cross-section of another embodiment of an electrospray interface.

The heater coil 204 and/or heating element 240 are optional in any of the embodiments described herein. As shown in FIGS. 3E, 3F and 3G, for example, the interface 200 can include a front cone 201, a first ceramic tube 203, a second ceramic tube 202, an end piece 205, and optionally a cylindrical cover 250 (shown in FIG. 3G), without a heater coil or heating element. In such embodiments, the cover 250 is also optional, e.g., as shown in FIGS. 3E and 3F. In these and other embodiments that do not include a heater coil or heating tube, heat can be conducted to the first ceramic tube from the end piece directly and/or through the second ceramic tube.

The interface may be mounted on the source block of a mass spectrometer by, for example, bolting or otherwise attaching end piece 205 to the first chamber 106 of mass spectrometer. End piece 205 and the mass spectrometer are maintained at or near ground. As noted above, front cone 201 of interface 200 is held at a high voltage.

The potential difference between front cone 201 and end piece 205 produces an electric field that opposes the motion of charged particles through inner bore 211 of first ceramic tube 203. For that reason, the inner diameter and length of inner bore 211 should be selected such that the flow of gas through inner bore 211 exerts a sufficient force on the charged particles so that they pass through inner bore 211 into the low pressure chamber 106 in the first stage of the mass spectrometer despite having to overcome an opposing electric field. Typically, the length of inner bore 211 is in the range of 1 cm to 4 cm or more, for example about 2 cm, and the inner diameter of inner bore 211 is between about 0.2 mm and about 1 mm, inclusive.

The length of second ceramic tube 202 substantially matches the length of first ceramic tube 203. The length of first ceramic tube 203 matches the length of inner bore 211. The outer diameter of first ceramic tube 203 can typically range from 1.0 mm to 3 mm. The outer diameter of second ceramic tube 202 can range from 3 mm to 15 mm, for example.

There are many ways to ensure electrical contact and leak tightness between front cone 201 and tube 203, and between tube 203 and end piece 205. These include, but are not limited to, the use of electrically conductive epoxy, press-fitting, and metallization of the ends of tube 203.

Figure 4A:
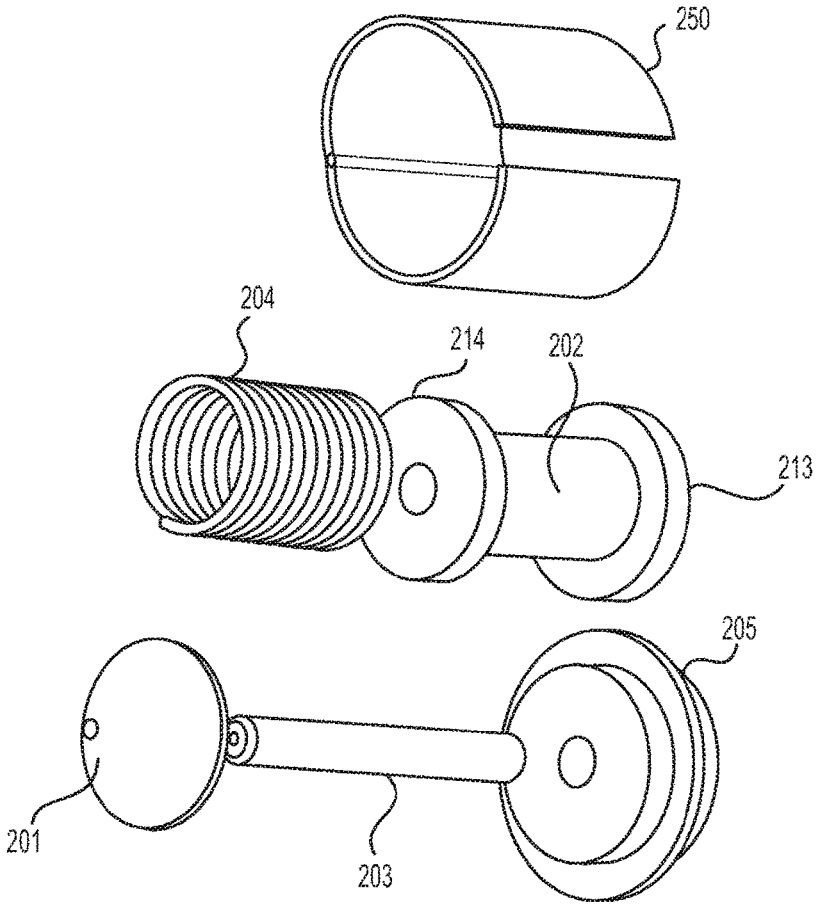
FIG. 4A is a schematic diagram showing components of the embodiment of the electrospray interface shown in FIG. 3A.
Figure 4B:
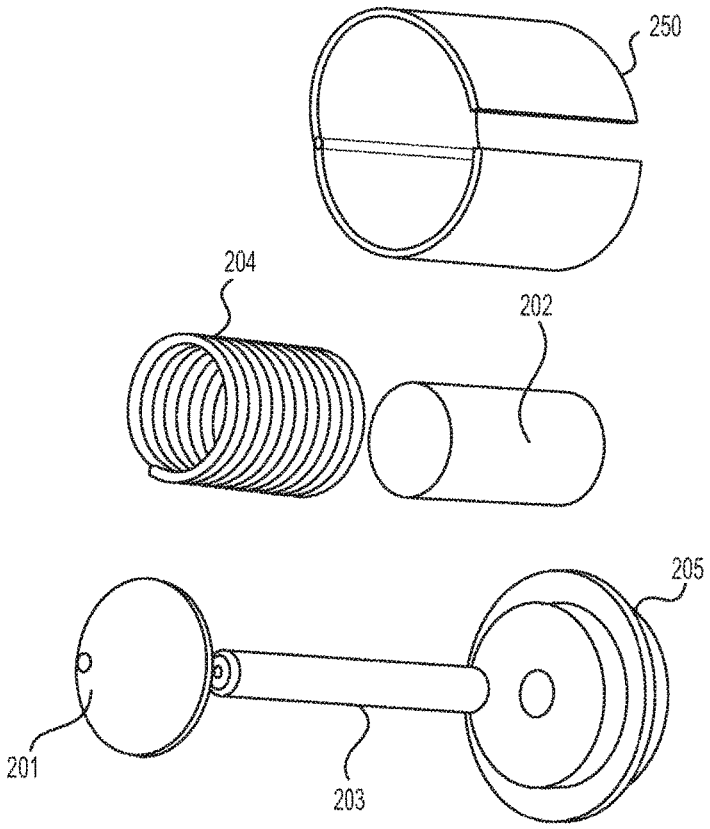
FIG. 4B is a schematic diagram showing components of the embodiment of the electrospray interface shown in FIG. 3B.
Figure 4C:
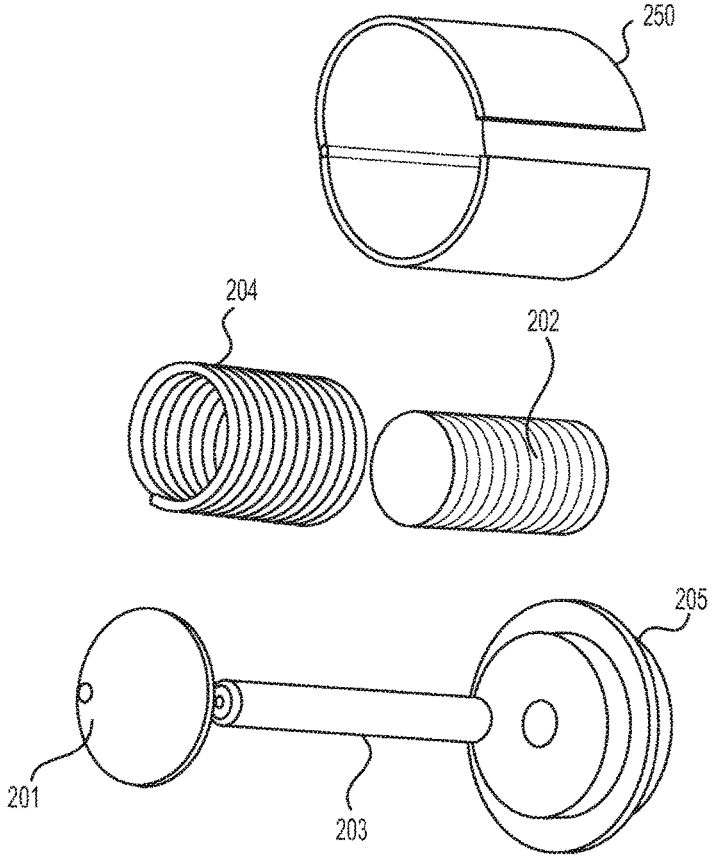
FIG. 4C is a schematic diagram showing components of the embodiment of the electrospray interface shown in FIG. 3C.
Figure 4D:
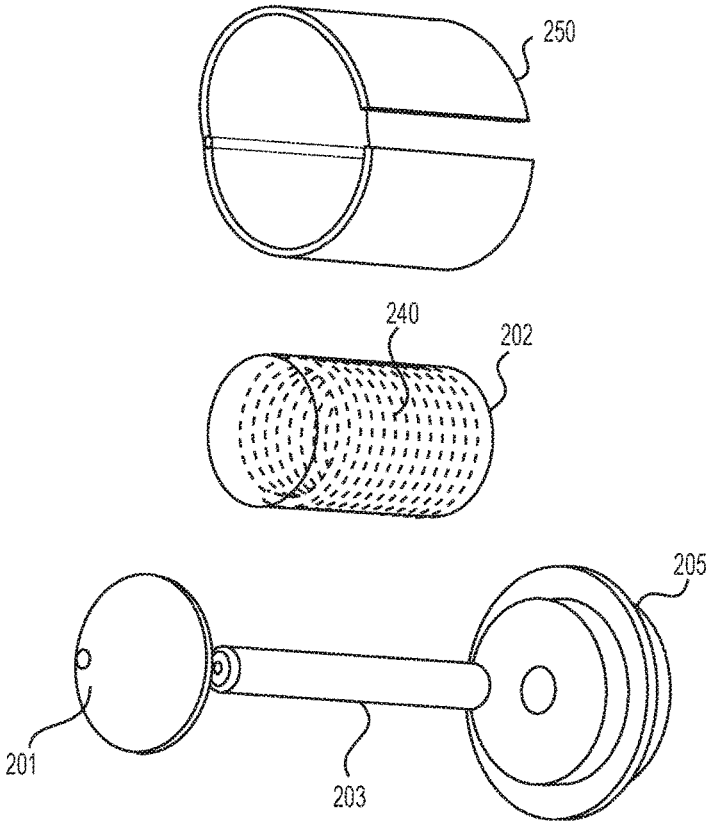
FIG. 4D is a schematic diagram showing components of the embodiment of the electrospray interface shown in FIG. 3D.

FIG. 4A is a schematic diagram showing several of the main components of electrospray interface 200 shown in FIG. 3A prior to their assembly: heater coil 204; second ceramic tube 202 (in this illustration forming a bobbin with end disks 213 and 214); end piece 205; first ceramic tube 203 and front cone 201.

The potential gradient along the first ceramic tube 203 from front cone 201 to end piece 205 should be as constant as possible, so as to avoid the creation of localized steeper gradients that would result from an uneven potential gradient. The high resistivity of the second ceramic tube insulates the metal heater coil from the first ceramic tube, and thus prevents the metal heater coil itself from disturbing the uniformity of this potential gradient.

Because the electrical resistivity of the second ceramic tube is two or three orders of magnitude higher than the electrical resistivity of the first ceramic tube, the electrical current that can flow from the first ceramic tube to the second ceramic tube is much smaller than the current flowing along the first ceramic tube. Generally, the current flowing along the first ceramic tube is very small, for example on the order of 0.01 milliamps, and is generally under 0.1 milliamps.

Also, because the resistivity of the first ceramic tube is highly temperature-dependent, the temperature of the first ceramic tube should be maintained as uniformly as possible along the length of the first ceramic tube, so that the first ceramic tube has a relatively uniform resistivity along its length. The relative uniformity of the resistivity of the first ceramic tube along its length thus serves to ensure that the potential gradient from front cone 201 to end piece 205 is as uniform as possible. The temperature uniformity along the first ceramic tube is maintained by controlling the thermal conductivity of the materials used for the first and second ceramic tubes.

The first ceramic material used to fabricate the first ceramic tube and the second ceramic material used to fabricate the second ceramic tube should both be good electrical insulators at room temperature. However, the electrical resistivity at room temperature of the second ceramic material should be at least two orders of magnitude higher than the electrical resistivity at room temperature of the first ceramic material, and may be three orders of magnitude or more higher. This ensures that the heater coil is sufficiently electrically insulated from the first ceramic tube and from the front cone. For example, the electrical resistivity at room temperature of the first ceramic material may be in the range of $10^6$ to $10^{12}$ Ω-cm and the electrical resistivity of the second ceramic material at room temperature may be in the range of $10^{12}$ to $10^{15}$ Ω-cm. The electrical resistivity of the second ceramic material at room temperature should be at least one and even two orders of magnitude higher than the electrical resistivity at room temperature of the first ceramic material, and this differential should continue throughout the intended operating temperature range of the interface.

Using ceramic materials that have relatively high thermal conductivity, such as the materials described below, ensures that the resistivity of the first ceramic tube is fairly constant along the length of the inner bore, because the electrical resistivity of ceramic materials generally decreases as a function of increasing temperature. Having a fairly constant resistivity along the first ceramic tube ensures that the potential gradient along the tube is fairly constant from the front end of the first ceramic tube (which is at 2-5 kV) to the back end of the first ceramic tube (which is at or near ground). This avoids having an uneven gradient which could result in an opposing local electric field being sufficiently strong such that it may slow down, halt or reverse the flow of ions along the inner bore of the first ceramic tube.

The thermal conductivity of the first ceramic material should be relatively high, for example above 1 W/m-K. For example, the thermal conductivity of the first ceramic material could be about 2-2.5 W/m-K or above. The thermal conductivity of the second ceramic material should typically be at least as high as, and usually preferably higher than, the thermal conductivity of the first ceramic material \and may be an order of magnitude higher, for example above 20 W/m-K. The thermal conductivity of the second ceramic material could be 70-100 W/m-K or higher, for example. The high thermal conductivity of the first ceramic material and the second ceramic material ensure that the droplets, clusters and ions flowing through inner bore 211 experience relatively uniform temperatures as they flow from entrance orifice 210 through inner bore 211 to exit orifice 212. Also, since heater coil 204 is wound around second ceramic tube 202, the higher thermal conductivity of the second ceramic material compared to the thermal conductivity of the first ceramic material ensures that the temperature of the first ceramic tube is fairly uniform. This results in a fairly uniform resistivity along the length of the first ceramic tube, which in turn ensures that the potential gradient from the front cone to the end piece along the first ceramic tube is relatively uniform.

Zirconia is a good example of a material that could be used as the first ceramic material. Pure zirconia has an electrical resistivity that can range as high as $10^{12}$ Ω-cm. Yttria-blended zirconia, which may have an electrical resistivity in the range of $10^8$ to $10^{12}$ Ω-cm, may also be used for the first ceramic material. Other zirconia blends may also be used. The reported thermal conductivity for various blends of zirconia range from 2 to 2.5 W/m-K. Certain Nickel-Zinc ferrites may also be suitable candidates. Examples are ferrite materials made by Fair-Rite Products Corporation of Wallkill, N.Y., such as their types 68, 67, 61, 52, 51, 44, 46, and 43. Certain specialty glasses also possess suitable electrical properties although they may lack the desired mechanical and thermal properties. Examples are soda-lime and alumino-silicate glasses such as those made by Abrisa Technologies of Santa Paula, Calif. Fluorophlogopite based ceramics such as are sold by Ariake Meterials Company, Tokyo, Japan are also usable. Silicon carbide, while not as highly resistive ($10^5$ to $10^8$ Ω-cm) as zirconia, has higher thermal conductivity (60 to 200 W/m-K) could also be used. There is also a family of ESD-safe ceramics sold by Coorstek, Golden, Colo. most of which have appropriate properties, including one based on alumina.

Aluminum nitride is a good example of a material that could be used as the second ceramic material. Aluminum nitride has an electrical resistivity that can range from $10^{12}$ to $10^{15}$ Ω-cm and a thermal conductivity that can range above 70 W/m-K. As another example, Shapal Hi-M soft may be used as the second ceramic material. It is a composite sintered body of aluminum nitride and boron nitride, has a reported electrical resistivity of $10^{15}$ Ω-cm, and a reported thermal conductivity of 92 W/m-K. Shapal Hi-M soft is available from Goodfellow USA (Coraopolis, Pa.) or Precision Ceramics US (Tampa, Fla.). Sapphire, which may have a thermal conductivity of about 25-35 W/m-K and an electrical resistivity above $10^{15}$ Ω-cm, is another material that may be used as the second ceramic material. Silicon nitride, which may have a thermal conductivity of about 30 W/m-K and an electrical resistivity above $10^{14}$ Ω-cm, is another material that may be used as the second ceramic material.

Certain compositions of Aluminum Nitride, such as a composition known as Medium Resistivity Aluminum Nitride developed by NGK Insulators, Ltd of Japan could also be used as a first material.

Figure 5A:
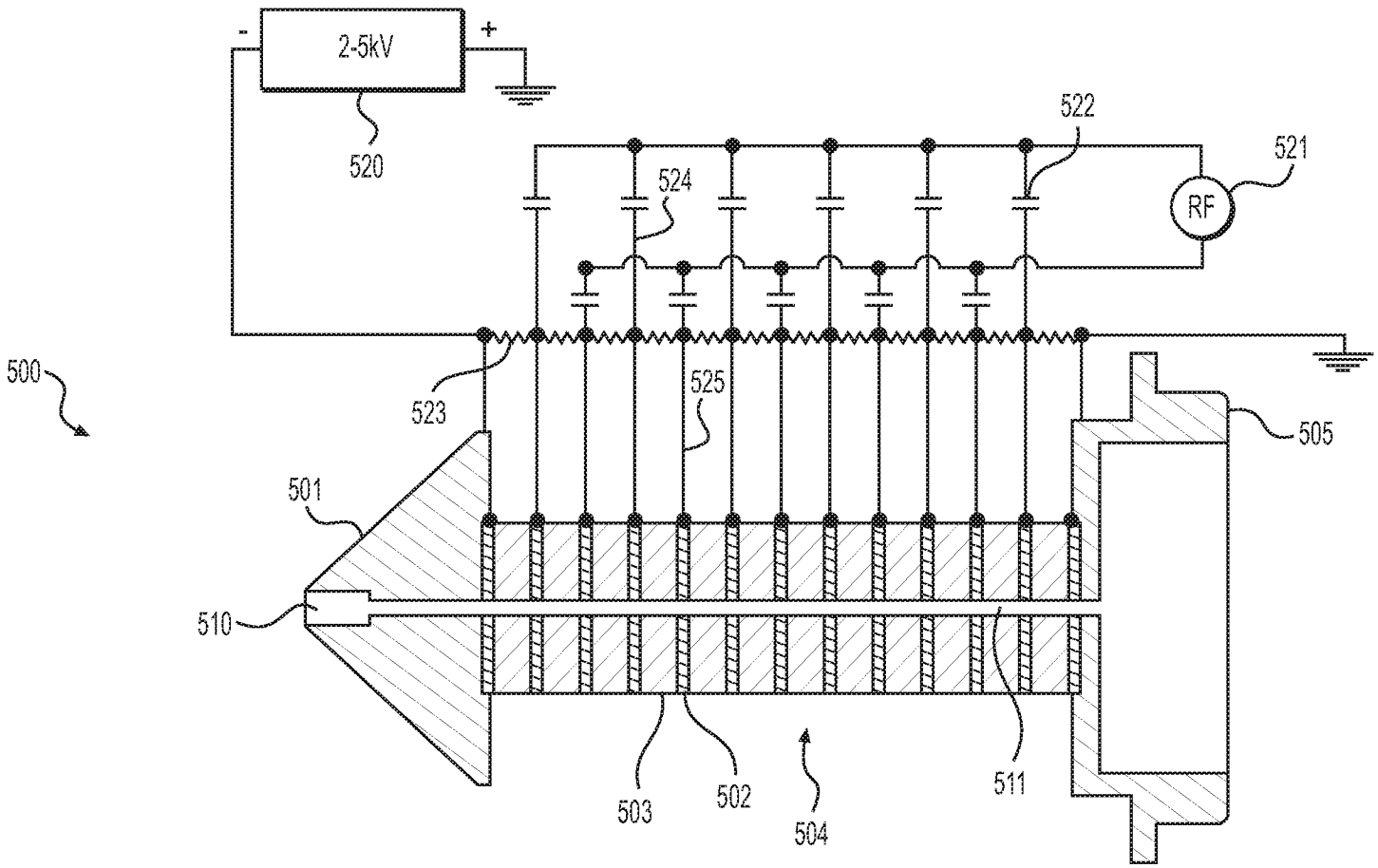
FIG. 5A is an alternative embodiment of an electrospray interface.

FIG. 5A is a schematic diagram of an alternative embodiment of an electrospray interface. This embodiment of electrospray interface 500 uses a tube 504 composed of alternating metal washers 502 and ceramic washers 503 to form an inner bore 511, instead of using a ceramic tube. It includes a front cone 501 with its entrance orifice 510 and end piece 505. Front cone 510 and end piece 505 may be fabricated of stainless steel or of another similarly electrically and thermally conductive corrosion-resistant material.

As in the embodiment of FIGS. 1-4, the front cone 501 of this embodiment is held at a high voltage in the range of 2 kV to 5 kV. This potential voltage is negative for generating positively-charged ions and positive for generating negatively-charged ions. End piece 505 is attached to the first chamber of mass spectrometer 110, and is therefore at or near ground. Resistors 523 are connected to their respective metal washers, as shown in FIG. 5A, and thus distribute a cascading potential voltage to each of the metal washers 502 ranging from 2-5 kV at the front end to at or near ground at the back end. Thus the metal washer next to the front cone is at the 2-5 kV potential, the metal washer next to the end piece 505 is at or near ground, and the intermediate washers are at intermediate potentials. This network of resistors controls the potential voltage that is applied to each metal washer. For example, if each of resistors 523 has the same value, then the potential voltage would descend with a roughly constant gradient from the 2-5 kV provided by power supply 520 at the front end to ground or near ground at the opposite end. As in the first embodiment, the embodiment of an electrospray interface shown in FIG. 5A does not have any steep gradients in the potential that might retard or reverse the flow of ions through bore 511 of tube 504.

As shown in FIG. 5A, RF source 521 applies potential voltages of opposite polarity to adjacent metal washers via capacitors 522 and electrical connections 524. RF source 521 may have a frequency in the range of 0.1 MHz to 3 MHz, for example 1 MHz-2 MHz, with an amplitude in the range of 100-500 volts. For example, the RF signal applied to the fourth metal washer (counting from the left) via electrical connection 524 is 180° out-of-phase with respect to the RF signal applied to the fifth metal washer via electrical connection 525. This RF signal serves to reduce the number of ions or other particles that collide with the wall of the inner tube. Collisions of ions with the wall of the inner tube are not desirable because the collisions prevent those ions from reaching the mass analyzer in the mass spectrometer system, and thus reduce the sensitivity of the mass spectrometer system. Interface 500 can also operate without the application of RF potentials (and the associated capacitors). However, in that case more ions may then be lost due to wall collisions.

Washers 502 are metal electrodes made of an electrically and thermally conductive material such as stainless steel. Washers 503 are ceramic insulators made of a ceramic material such as zirconia, sapphire, silicon carbide, silicon nitride, Shapal Hi-M soft or aluminum nitride, or other materials that are both electrical insulators (or at least highly resistive) and are also thermally conductive. Because the ceramic washers are thermally conductive, the ions travelling through inner bore 511 experience relatively uniform temperatures as they pass through inner bore 511. The electrical resistivity of the ceramic material should be at least about $10^7$ Ω-cm and the thermal conductivity of this ceramic material should be at least 1 W/m-K, preferably 2-2.5 W/m-K or above.

The holes in the center of washers 502 and 503 align with each other and with orifice 510 in front cone 501 such that there is a bore 511 through electrospray interface 500. The washers have a hole in their center with an inner diameter of 0.2 to 1 mm, and may have outer diameters in the range of 3-10 mm. The thickness of metal washers 502 is typically in the range of 0.2-0.3 mm, for example 0.25 mm. The thickness of ceramic washers 503 is typically in the range of 0.5-1.0 mm, for example 0.75 mm. FIG. 5A shows a total of 12 "sandwiches" of metal-ceramic-metal washers, for a total length of approximately 12.25 mm based upon 0.25 mm for the metal washers and 0.75 mm for the ceramic washers. However, the total number of such "sandwiches" may range from eight to twenty or more, and the overall length of interface 500 could range from approximately 8 mm to approximately 30 mm or more. As shown in FIG. 5A, the assembled series of metal washers and ceramic washers form a tube 504 with an inner bore 511 through which droplets, clusters and ions can flow.

Front cone 501, metal washers 502, ceramic washers 503 and end piece 505 may be bonded together by appropriate means to ensure alignment and mechanical robustness. Also, although bores 211 and 511 are depicted as cylindrical in the drawings, they may have other shapes. For example, bores 211 and 511 may be fabricated as roughly rectangular slits. They may also be replaced by a plurality of bores. Furthermore, although tubes 203 and 504 are shown as cylindrical, in the drawings, their outer surfaces could have a different shape.

Figure 5B:
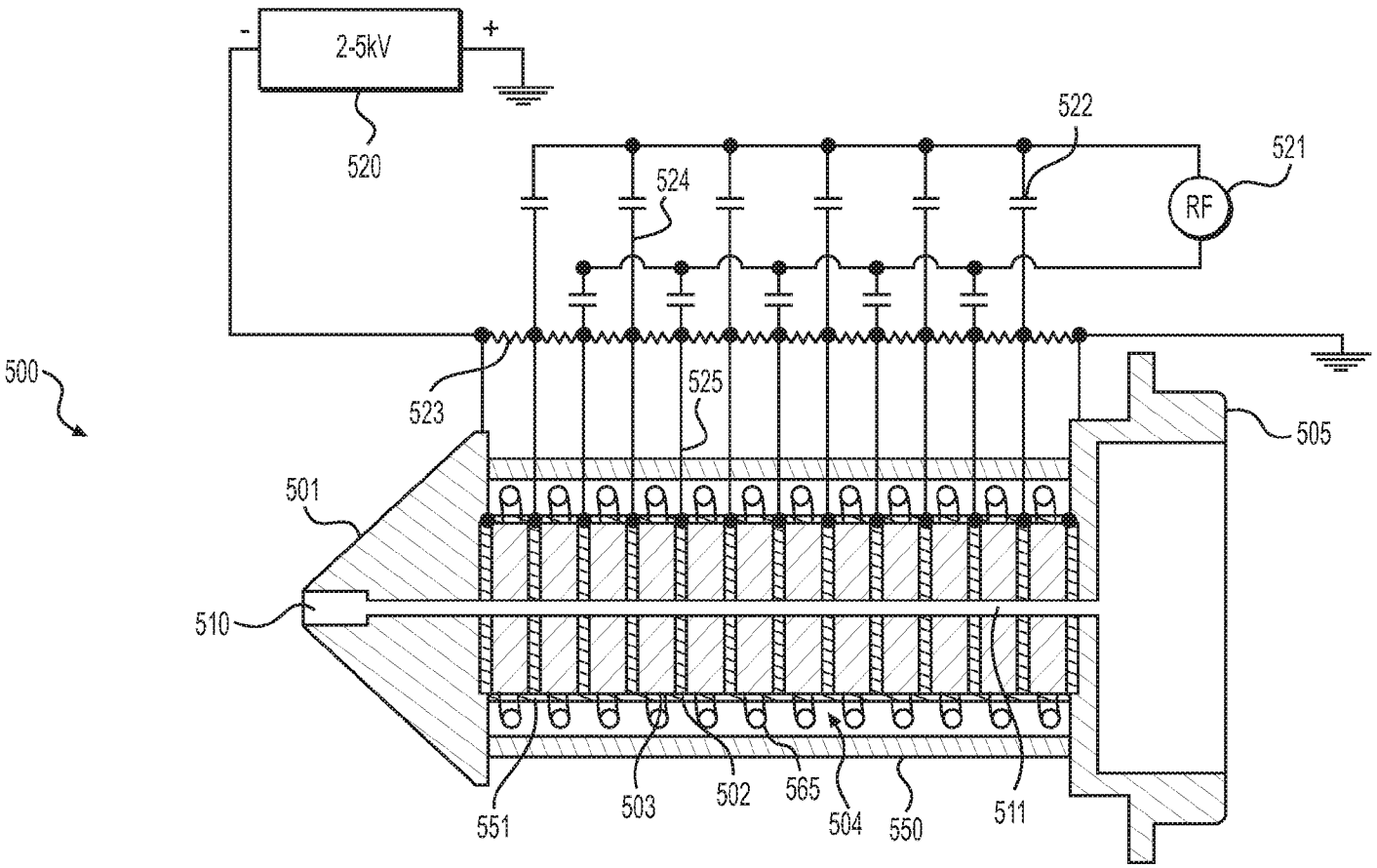
FIG. 5B is an electrospray interface similar to the electrospray interface shown in FIG. 5A, with a heater coil.

Embodiments similar to the embodiment shown in FIG. 5A may incorporate a heater to assist in desolvating droplets and clusters as they flow through inner tube 504. The heater could be an electrically insulated heater coil 565 wound around inner tube 504, as shown in FIG. 5B. A cylindrical outer shield 550 may be used to protect heater coil 565. A tube or clamshell 551 made of a high thermal conductivity ceramic such as Shapal Hi M soft with appropriate means to accommodate electrical connections to metal washers 502 may be interposed between heater coil 565 and tube 504 to promote the even distribution of heat from coil 565. The use of thermally conductive ceramic washers 504, together with the thermally conductive metal electrodes also ensure that the temperature along inner bore 511 is relatively uniform.

Figure 6:
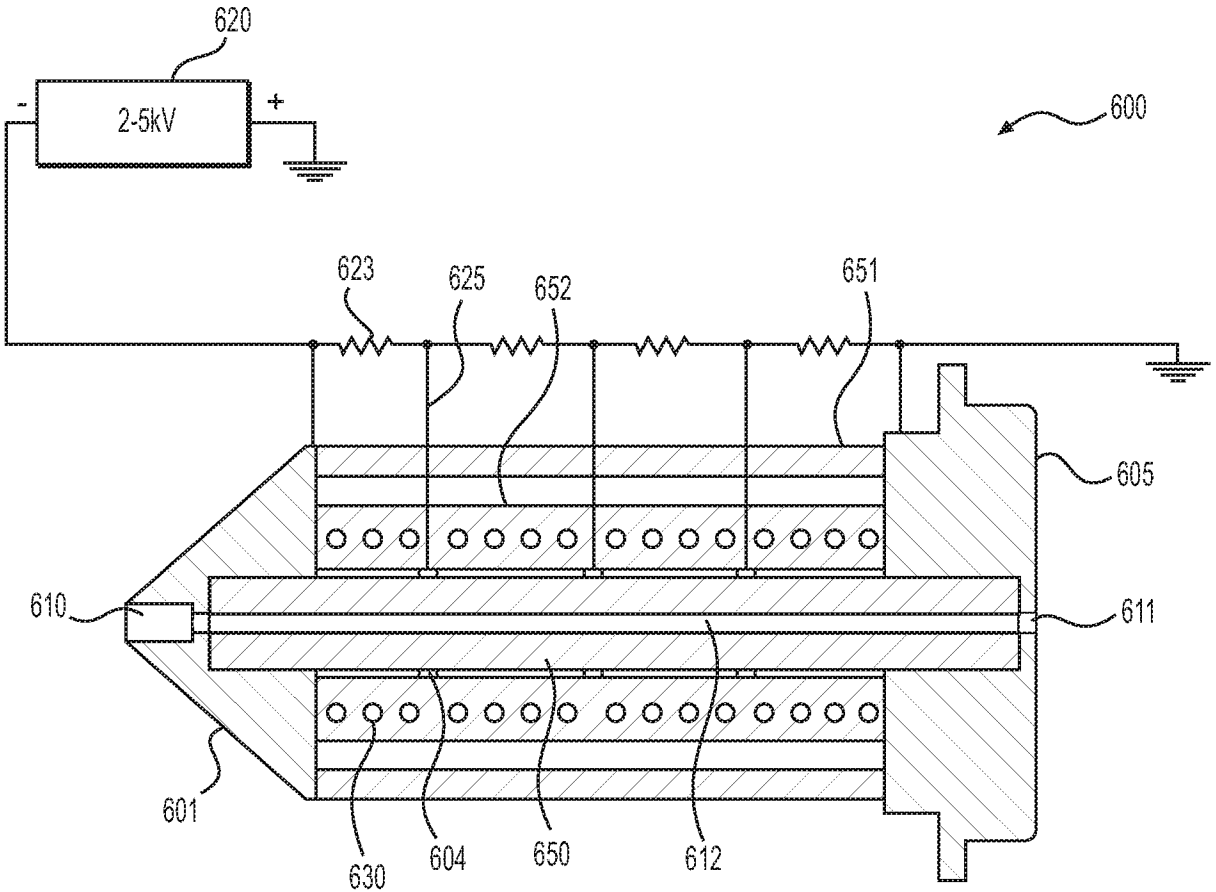
FIG. 6 is a schematic diagram of another embodiment of an electrospray interface.

FIG. 6 is a schematic diagram of another embodiment of an electrospray interface. In this embodiment, electrospray interface 600 has a network of resistors 623 that distributes voltage from a minus 2-5 kV power supply to ring electrodes 604 that encircle ceramic inner tube 650. Ceramic inner tube 650 may be fabricated from the first ceramic material, which is described above. For example, ceramic inner tube 650 may be fabricated from zirconia, an yttria-zirconia blend, another zirconia blend ceramic, or from another ceramic material that has both high electrical resistivity and high thermal conductivity. Inner tube 650 extends from near orifice 610 at front cone 601 to near exit orifice 611 at end piece 605. Ions and other charged particles entering the electrospray interface 600 are entrained by the gas flow through inner bore 612 and travel from entrance orifice 610 to exit as ions from exit orifice 611. The number and spacing of ring electrodes 604 and the value of each of the individual resistors 623 may be selected to tailor the voltage drop across inner tube 650 from its front cone end to its end piece end.

Intermediate ceramic tube 652 may be made of the second ceramic material, which is described above. For example, it may be fabricated from AlN (aluminum nitride) or Shapal Hi-M soft. It may include embedded heater elements 630. Outer ceramic tube 651, which is made of a good thermal and electrical insulator such as glass or porcelain, provides a protective shield over the electrospray assembly.

Ring electrodes 604 may be deposited metal films, separate metal rings made from two half-circles press-fitted onto the ceramic tube, circumferential metal rings, or any other suitable means for applying a high potential to the circumference of a ceramic tube.

Figure 7:
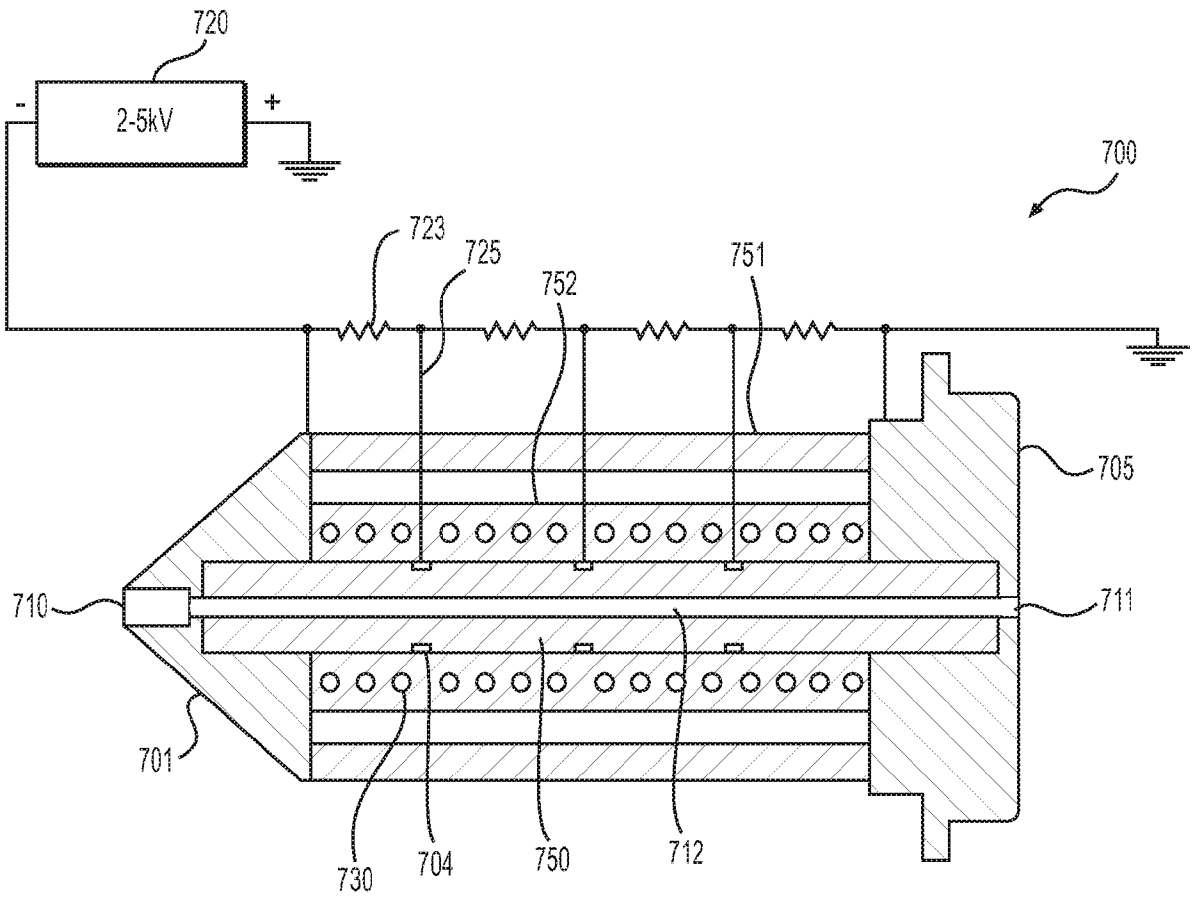
FIG. 7 is a schematic diagram of another embodiment of an electrospray interface.

FIG. 7 shows an embodiment of an electrospray interface that is generally similar to the embodiment shown in FIG. 6, but uses embedded ring electrodes 704 instead of circumferential electrodes as in the embodiment of FIG. 6. Ions and other charged particles entering entrance orifice 710 are entrained by the gas flow through inner bore 712 and travel through ceramic tube 750 to exit orifice 711. Voltage from the minus 2-5 kV power supply 720 is distributed via resistor network 723 to ring electrodes 704 that are embedded in inner ceramic tube 750. Inner ceramic tube 750 is made from a first ceramic material, such as zirconia or a zirconia-yttria blend or from another ceramic material that has both high electrical resistivity and high thermal conductivity. It is in good thermal contact with an intermediate ceramic tube made from a second ceramic material such as AlN (aluminum nitride) and Shapal Hi-M soft that has both high electrical resistivity and high thermal conductivity. Intermediate ceramic tube 752 may be made of the second ceramic material, which is described above. Intermediate ceramic tube 752 may include an embedded heater element 730. For example, it may be fabricated from AlN (aluminum nitride) or Shapal Hi-M soft, and may include embedded heater elements, such as the heater elements described above with reference to FIG. 3D. Optional outer ceramic tube 751, which is made of a good thermal and electrical insulator such as glass or porcelain may provide a protective shield over the electrospray assembly.

Figure 8:
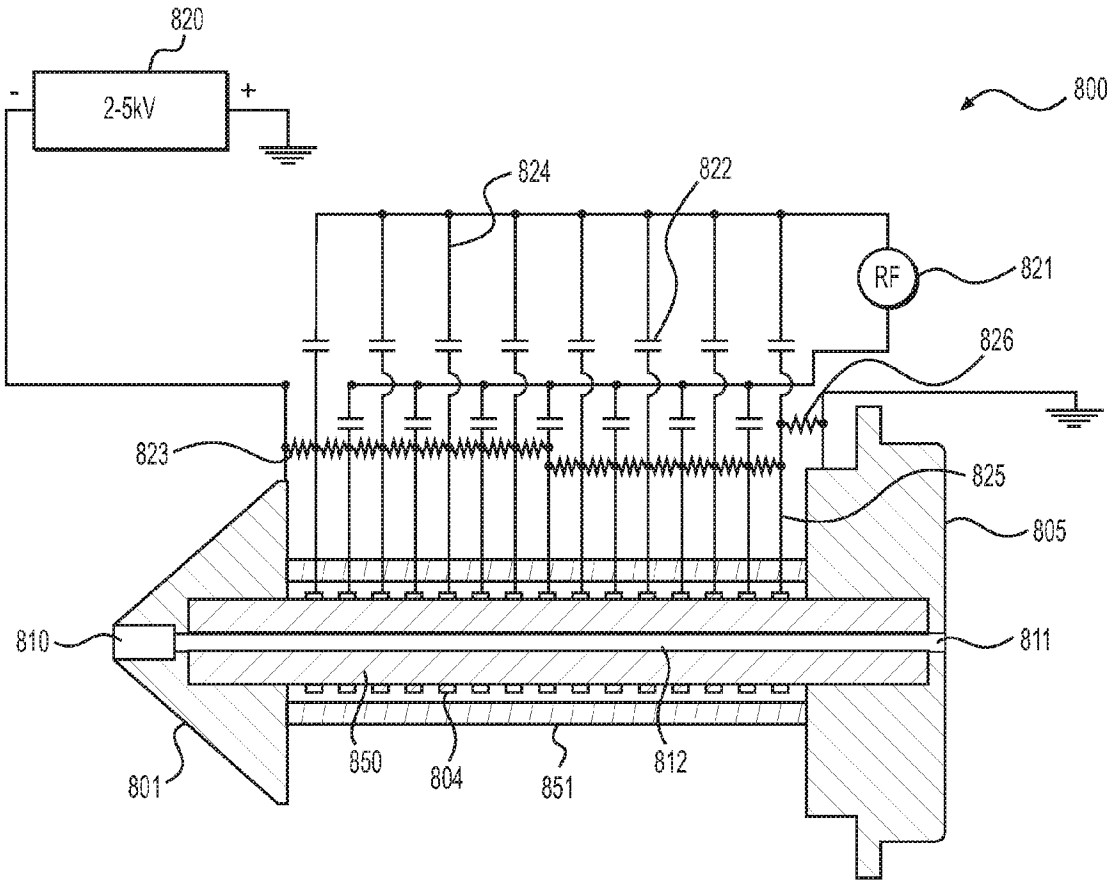
FIG. 8 is a schematic diagram of another embodiment of an electrospray interface.

FIG. 8 is a schematic diagram of another embodiment of an electrospray interface. In this embodiment, electrospray interface 800 has ring electrodes 804 that encircle inner ceramic tube 850. Inner ceramic tube 850 is fabricated from a material such as zirconia or ytrria-blended zirconia or another zirconia blend, having the electrical and thermal properties described above. Outer ceramic tube 851 may be made of AlN (aluminum nitride) or Shapal Hi-M soft, and incorporates an embedded heater (such as the embedded heaters shown schematically in FIGS. 6 and 7) that maintains the temperature inside inner bore 812 in the range of 65° C. to 225° C., for example from about 100° C. to 180° C. Charged particles enter entrance orifice 810 in front cone 801, travel through inner bore 812 and exit via exit orifice 811 in end piece 805. As the charged particles travel through inner bore 812, any clusters and droplets that enter inner bore 812 may be desolvated as they travel through inner bore 812, such that almost all of the charged particles that exit inner bore 812 do so as ions.

Power supply 820 is applied to resistive network 823 and resistor 826 to distribute a DC potential ranging from near minus 2-5 kV at front cone 801 to near ground at end piece 805. RF source 821 applies an RF signal via capacitors 822 and electrical connections 824 and 825 to electrodes 804 which encircle inner ceramic tube 850. In this embodiment, the frequency of the applied RF field and the resistivity of the first ceramic material are selected such that a substantial fraction of the RF field penetrates through the inner ceramic tube.

According to equation 4 in U.S. Pat. No. 4,013,887, a material behaves as a dielectric with regard to transmission of an RF electric field through the material when the quantity $4\pi\sigma/\omega\varepsilon<1$, where $\sigma$ is the electrical conductivity of the material in question, $\omega$ is the angular frequency of the RF field, and $\varepsilon$ is the dielectric constant of the material. For blended ceramics, $\varepsilon$ and $\sigma$ from different vendors vary, but a typical value for yttria-stabilized zirconia are $\varepsilon=29$ and $\sigma=10^8$ Ω-cm. In cgs units, this resistivity is equivalent to an electrical conductivity of about $10^{-4}$ $sec^{-1}$. Thus for an RF frequency of $10^6$ Hz, the quantity $4\pi\sigma/\omega\varepsilon$ is about $6\times10^{-4}$ which is substantially less than 1. Thus it is evident that for this frequency, an RF field will be substantially transmitted through such a material. For a resistivity of $10^6$ Ω-cm, the quantity $4\pi\sigma/\omega\varepsilon$ is about $6\times10^{-2}$ which is still substantially less than 1. Thus frequencies of $10^6$ Hz and up can be successfully transmitted through materials whose resistivities range from $10^6$ Ω-cm and up. Frequencies of $10^5$ Hz and up can be successfully transmitted through materials whose resistivities range from $10^7$ Ω-cm and up.

Figure 9:
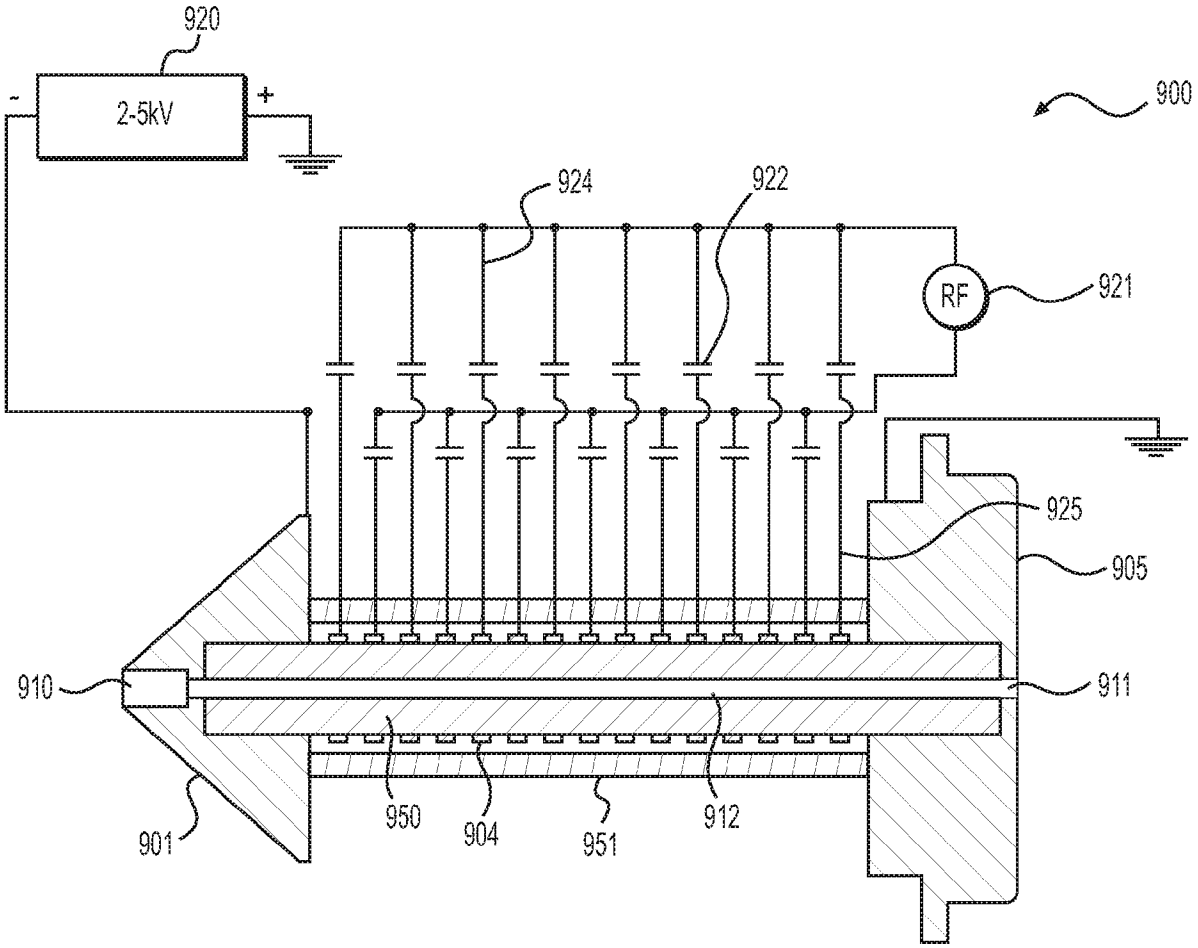
FIG. 9 is a schematic diagram of another embodiment of an electrospray interface.

Electrospray interface 900 shown in FIG. 9 is generally similar to the electrospray interface 800 shown in FIG. 8, but applies the minus 2-5 kV potential only between front cone 901 and end piece 905. The electrical resistance of the inner ceramic tube 950 thus has a potential near minus 2-5 kV at the front cone 901 and is near ground at end piece 905, and the absolute value of the potential decreases monotonically from front cone 901 to end piece 905.

In this embodiment, charged particles enter entrance orifice 910 in front cone 901, travel through inner bore 912 of inner ceramic tube 950 and exit via exit orifice 911 in end piece 905. The charged particles are heated by outer ceramic tube 951, which has an embedded heater (such as the embedded heaters shown in FIGS. 6 and 7), such that almost all of the charged particles exiting through exit orifice 911 are ions. The materials used for inner ceramic tube 950 may be similar to the materials used for inner ceramic tube 850 in the embodiment of FIG. 8, and the materials used for outer ceramic tube 951 may be similar to the materials used for the outer ceramic tube in the embodiment of FIG. 8.

RF source 921 applies an RF signal via capacitors 922 and electrical connections 924 and 925 to electrodes 904 which encircle inner ceramic tube 950. In this embodiment, the frequency of the applied RF field and the resistivity of the first ceramic material are selected such that a substantial fraction of the RF field penetrates through the inner ceramic tube. Frequencies of $10^6$ Hz and up can be successfully transmitted through materials whose resistivities range from $10^6$ Ω-cm and up. Frequencies of $10^5$ Hz and up can be successfully transmitted through materials whose resistivities range from $10^7$ Ω-cm and up.

Figure 10:
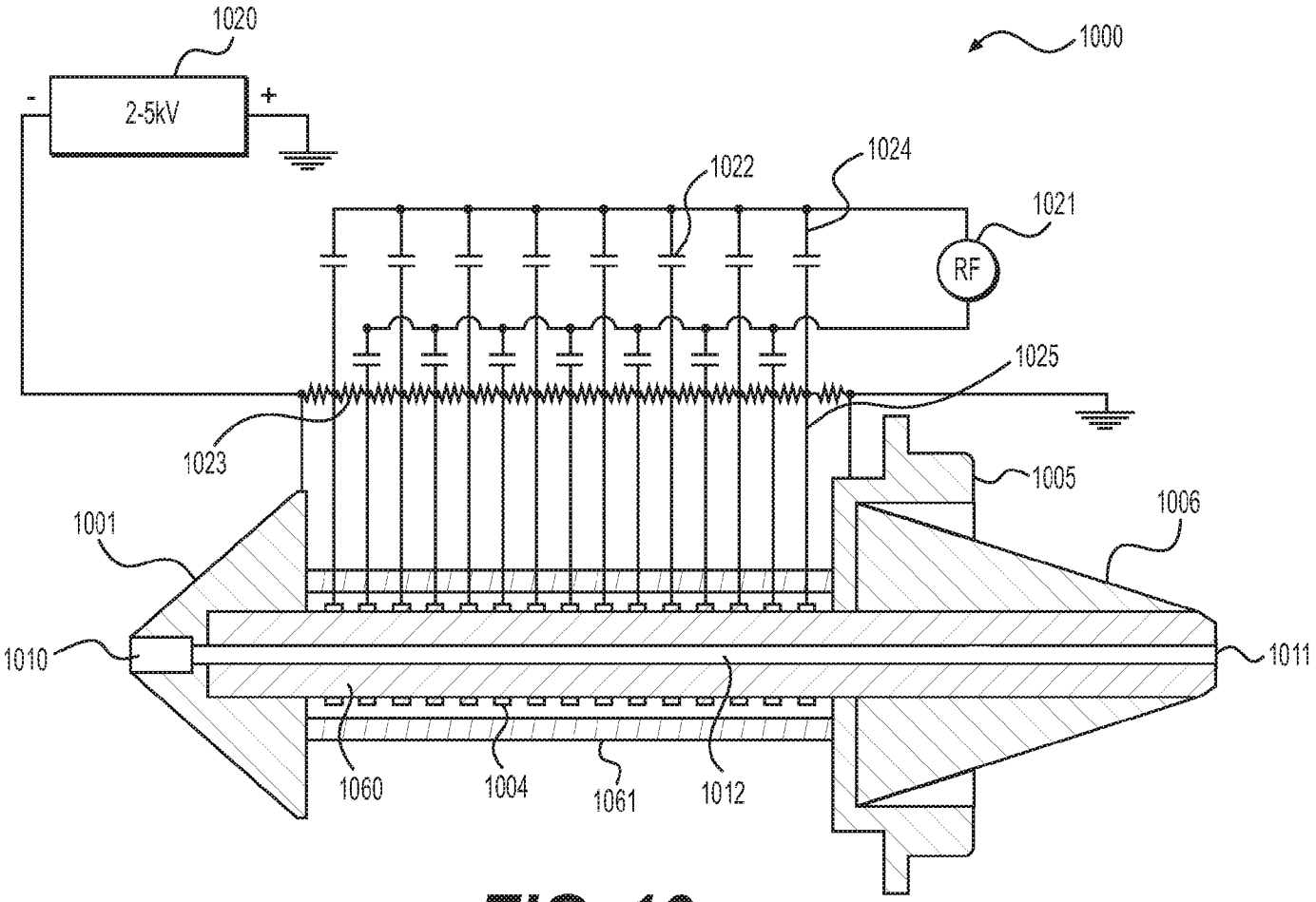
FIG. 10 is a schematic diagram of another embodiment of an electrospray interface.

FIG. 10 shows another embodiment of an electrospray interface which is generally similar to the embodiment of FIG. 8, but uses a conical ceramic end piece 1006 to extend the inner ceramic tube into the first chamber of vacuum system of the mass spectrometer (such as chamber 106 shown in FIG. 1).

In this embodiment, electrospray interface 1000 has ring electrodes 1004 that encircle inner ceramic tube 1060. Inner ceramic tube 1060 is fabricated from a material, such as zirconia or ytrria-blended zirconia or another zirconia blend, having the electrical and thermal properties described above. Outer ceramic tube 1061 may be made of AlN (aluminum nitride) or Shapal Hi-M soft, and incorporates an embedded heater (such as the embedded heater shown in FIGS. 6 and 7) that maintains the temperature inside inner bore 1012 in the range of 65° C. to 225° C., for example from about 100° C. to 180° C. Charged particles enter entrance orifice 1010 in front cone 1001, travel through inner bore 1012 and end piece 1005, are desolvated during their passage through inner bore 1012 and exit as ions via exit orifice 1011 in ceramic end cone 1006. Ceramic end cone 1006 is made of the same material as outer ceramic tube 1061 and is in direct thermal contact with the end portion of inner ceramic tube 1060, and also in thermal contact with outer ceramic tube 1060 via end piece 1005. Thus ceramic end cone 1006 is heated by the embedded heater in outer ceramic tube 1061 by thermal conduction through inner ceramic tube 1060 and end piece 1005. As the charged particles travel through inner bore 1012, any clusters and droplets that enter inner bore 1012 may be desolvated as they travel through inner bore 1012, such that almost all of the charged particles that exit inner bore 1012 do so as ions.

Power supply 1020 is applied to resistive network 1023 to distribute a DC potential ranging from minus 2-5 kV at front cone 1001 to near ground at end piece 1005. RF source 1021 applies an RF signal via capacitors 1022 and electrical connections 1024 and 1025 to electrodes 1004 which encircle inner ceramic tube 1060. In this embodiment, the frequency of the applied RF field and the resistivity of the first ceramic material are selected such that a substantial fraction of the RF field penetrates through the inner ceramic tube. Frequencies of $10^6$ Hz and up can be successfully transmitted through materials whose resistivities range from $10^6$ Ω-cm and up. Frequencies of $10^5$ Hz and up can be successfully transmitted through materials whose resistivities range from $10^7$ Ω-cm and up.

End cone 1006 extends inner bore 1012 into the first stage of a mass spectrometer and thus facilitates efficient transmission of desolvated ions into the subsequent ion guiding and focusing devices of the mass spectrometer system. Also, in the embodiment of FIG. 10, the exit 1011 from inner bore 1012 is further removed from any fringing electrical fields that may occur at the end of the inner ceramic tube. Thus any effect from the fringing fields, which may tend to defocus the ions, occur well inside inner bore 1012, where the flow of collimated gas can counteract any defocusing effects.

Figure 11:
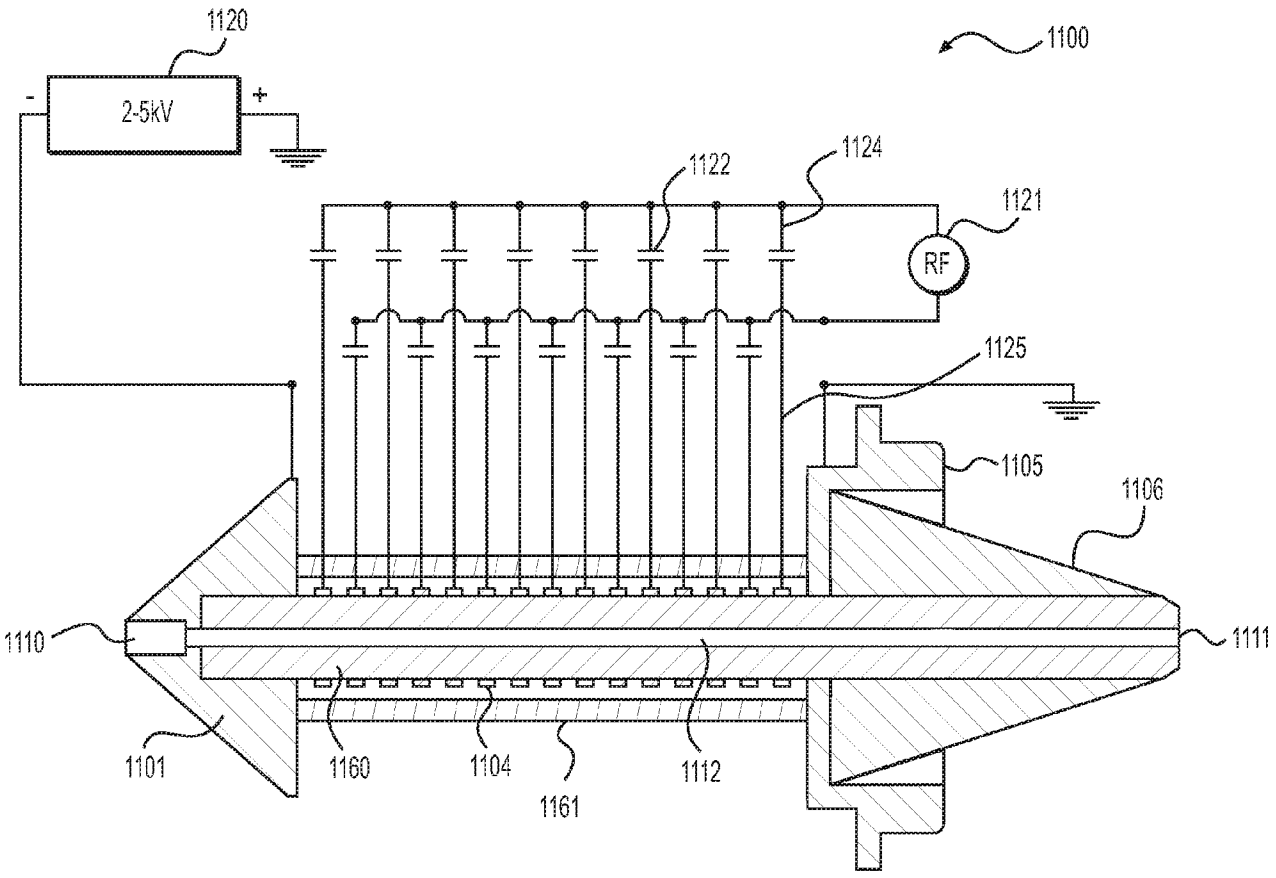
FIG. 11 is a schematic diagram of another embodiment of an electrospray interface.

FIG. 11 shows an embodiment similar to the embodiment of FIG. 10, except that it does not have a network of resistors to distribute the minus 2-5 kV potential across inner ceramic tube 1160. In this embodiment, ring electrodes 1104 encircle inner ceramic tube 1160. Inner ceramic tube 1160 is fabricated from a material such as zirconia or ytrria-blended zirconia or another zirconia blend, having the electrical and thermal properties described above. Outer ceramic tube 1161 may be made of AlN (aluminum nitride) or Shapal Hi-M soft, and incorporates an embedded heater that maintains the temperature inside inner bore 1112 in the range of 65° C. to 225° C., for example from about 100° C. to 180° C. Charged particles enter entrance orifice 1110 in front cone 1101, travel through inner bore 1112 and end piece 1105, are desolvated as they travel through inner bore 1112 and exit via exit orifice 1111 in ceramic end cone 1106 as ions. Ceramic end cone 1106 is made of the same material as outer ceramic tube 1161, is in direct thermal contact with the end portion of inner ceramic tube 1160, and is also in thermal contact with outer ceramic tube 1160 via end piece 1105. Thus ceramic end cone 1106 is heated by the embedded heater (such as the embedded heater shown schematically in FIGS. 6 and 7) in outer ceramic tube 1161 by thermal conduction through inner ceramic tube 1160 and end piece 1105. As the charged particles travel through inner bore 1112, any clusters and droplets that enter inner bore 1112 may be desolvated as they travel through inner bore 1112, such that all or almost all of the charged particles that exit inner bore 1112 do so as ions.

Power supply 1120 applies a DC potential ranging from minus 2-5 kV at front cone 1101 to near ground at end piece 1105. RF source 1121 applies an RF signal via capacitors 1122 and electrical connections 1124 and 1125 to electrodes 1104 which encircle inner ceramic tube 1160. In this embodiment, the frequency of the applied RF field and the resistivity of the first ceramic material are selected such that a substantial fraction of the RF field penetrates through the inner ceramic tube.

End cone 1106 extends inner bore 1112 and thus facilitates efficient transmission of desolvated ions into the subsequent ion guiding and focusing devices in a mass spectrometer system such as mass spectrometer system 100 shown in FIG. 1. Also, as in the embodiment of FIG. 10, the exit 1111 from inner bore 1112 is further removed from any fringing electrical fields that may occur at the end of the inner ceramic tube. Thus any effect from the fringing fields, which may tend to defocus the ions, occurs well inside inner bore 1112, where the flow of collimated gas can counteract any defocusing effects.

Figure 12:
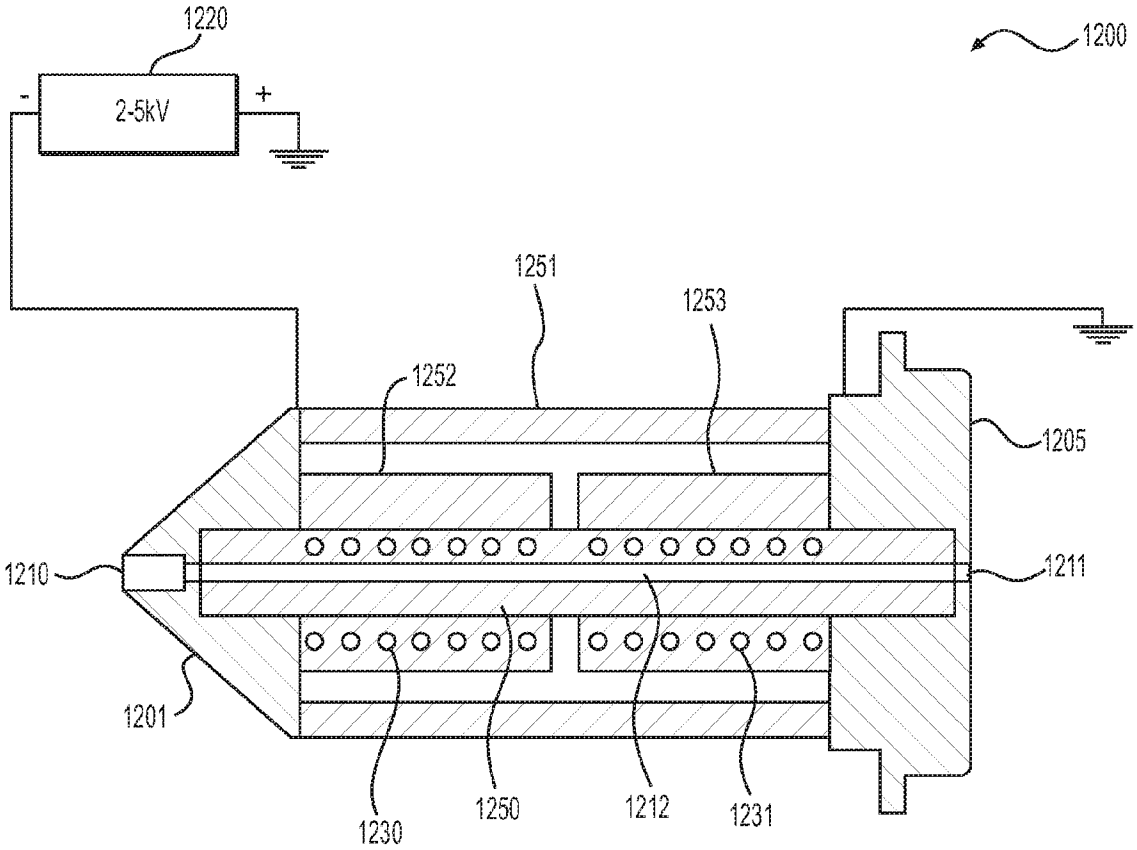
FIG. 12 is a schematic diagram of another embodiment of an electrospray interface.

FIG. 12 is a schematic diagram of another embodiment of an electrospray interface. In this embodiment, the resistivity of inner ceramic tube 1250 is controlled in part by independently controlling the temperature of front intermediate ceramic tube 1252 and the temperature of end intermediate ceramic tube 1253. Front intermediate ceramic tube 1252 incorporates an embedded heater 1230 and end intermediate ceramic tube 1253 incorporates an embedded heater 1231. Heater 1230 and heater 1231 are controlled independently from each other, such that a temperature differential may be established between the temperature of the front portion of inner ceramic tube 1250 and the end portion of inner ceramic tube 1250.

Inner ceramic tube 1250 is manufactured from a material similar to the first ceramic material and has electrical and thermal properties similar to the properties of the first ceramic material. For example, inner ceramic tube 1250 may be manufactured from zirconia, an zirconia-yttria blend or from another zirconia blend. As discussed above, the resistivity of such materials is a strong function of temperature. Front intermediate ceramic tube 1252 and end intermediate ceramic tube 1253 may be manufactured from a material that has electrical and thermal properties similar to the properties of the second ceramic material, such as AlN (aluminum nitride) or Shapal Hi-M soft. Outer cylinder 1251 may be made of a material that is both a good electrical insulator and a good thermal insulator, such a porcelain or glass.

In operation, for example, the front intermediate ceramic tube 1252 may be held at a higher temperature than the temperature of the end intermediate tube 1253. In that case, the potential drop applied by the minus 2-5 kV DC power supply 1220 over the front portion of inner ceramic tube 1250 will be smaller than the potential drop over the end portion of inner ceramic tube 1250. Conversely, if the front intermediate ceramic tube 1252 is held at a lower temperature than the temperature of the end intermediate tube 1253, the potential drop over the front portion of inner ceramic tube 1250 will be higher than the potential drop over the end portion of inner ceramic tube 1250.

Thus the embodiment of FIG. 12 allows an operator to control the flow of charged particles from entrance orifice 1210 in front cone 120 through inner bore 1212 to exit via exit orifice 1211 in end piece 1205 by controlling the temperature of different portions of the inner ceramic tube. Although this embodiment is shown in FIG. 12 as having two intermediate ceramic tubes, it may also be made with three, four or more intermediate ceramic tubes, which would provide the user with even more flexibility in designing experiments.

Figure 13:
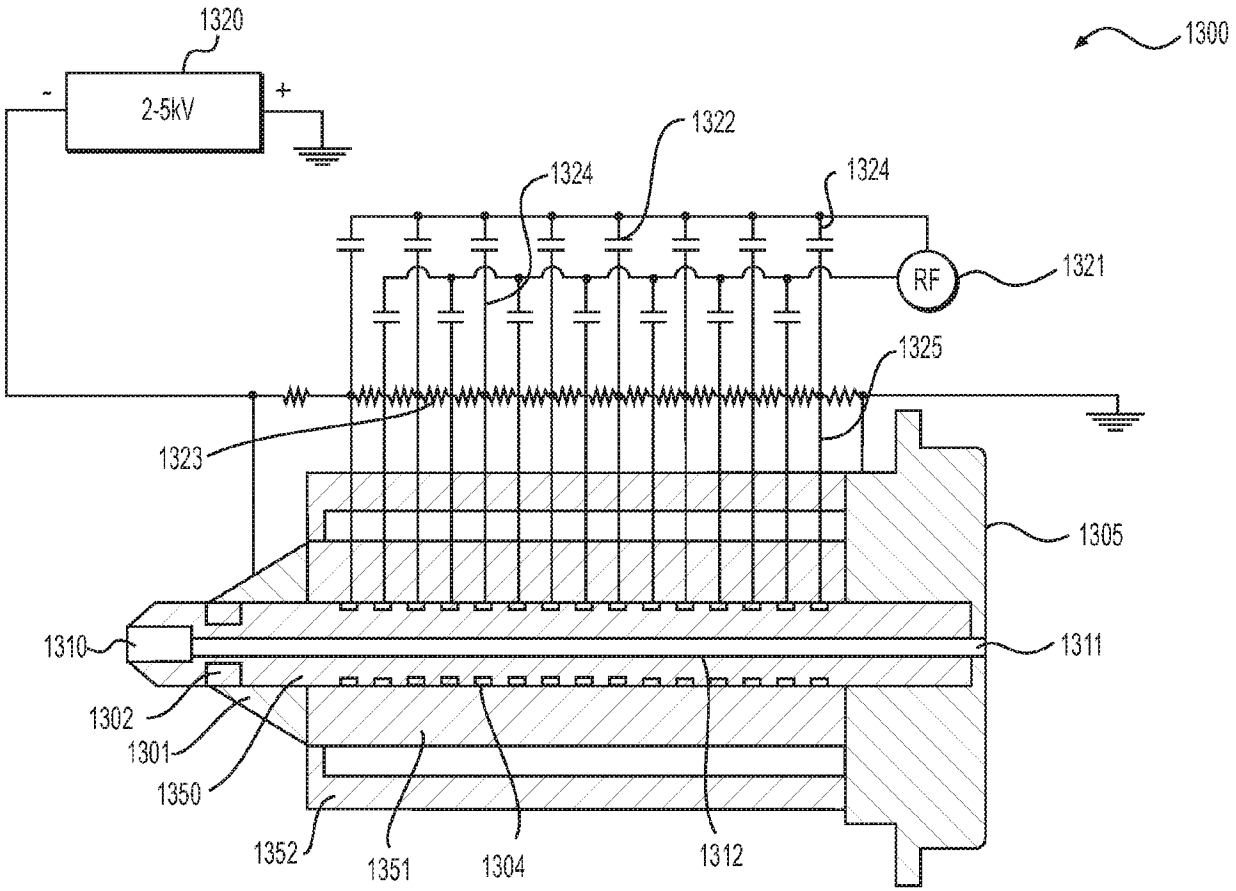
FIG. 13 is a schematic diagram of another embodiment of an electrospray interface.

FIG. 13 is a schematic diagram of another embodiment of an electrospray interface. In this embodiment, electrospray interface 1300 has an inner ceramic tube 1350 that projects into the atmosphere beyond front cone 1301. This embodiment allows the front end of the inner ceramic tube 1350 to sample the droplets, clusters and ions in the electrospray directly. Inner ceramic tube 1350 may be fabricated from materials similar to the first ceramic material, such a zirconia, yttria-blended zirconia or other zirconia blends that have high electrical resistivity and good thermal conductivity, as described above. Inner bore 1312 extends from entrance orifice 1310 in inner ceramic tube 1350 to exit orifice 1311 in end piece 1305. Front cone 1301 and end piece 1305 may be made from a conductive material such as stainless steel. Front ring electrode 1302, which may be made of stainless steel, is in electrical and thermal contact with front cone 1301. The high voltage potential from power supply 1320 is applied to front cone 1301 and thus to electrode 1302. End piece 1305 is held at or near ground.

The embodiment shown in FIG. 13 also has an intermediate ceramic tube 1351 which incorporates an embedded heater similar to the example shown schematically in FIGS. 3D, 6 and 7 and described with reference to FIG. 3D. Optional outer tube 1352 is made of an electrically and thermally insulating material such as porcelain or glass, and provides a protective shield to the assembly shown in FIG. 13. Resistor network 1323 distributes the potential from minus 2-5 kV power supply 1320 to electrodes 1304 which are embedded (as shown in FIG. 13) or which encircle inner ceramic tube 1350. RF source 1321 applies an RF signal to electrodes 1304 via capacitors 1322 and electrical connections 1324.

Figure 14A:
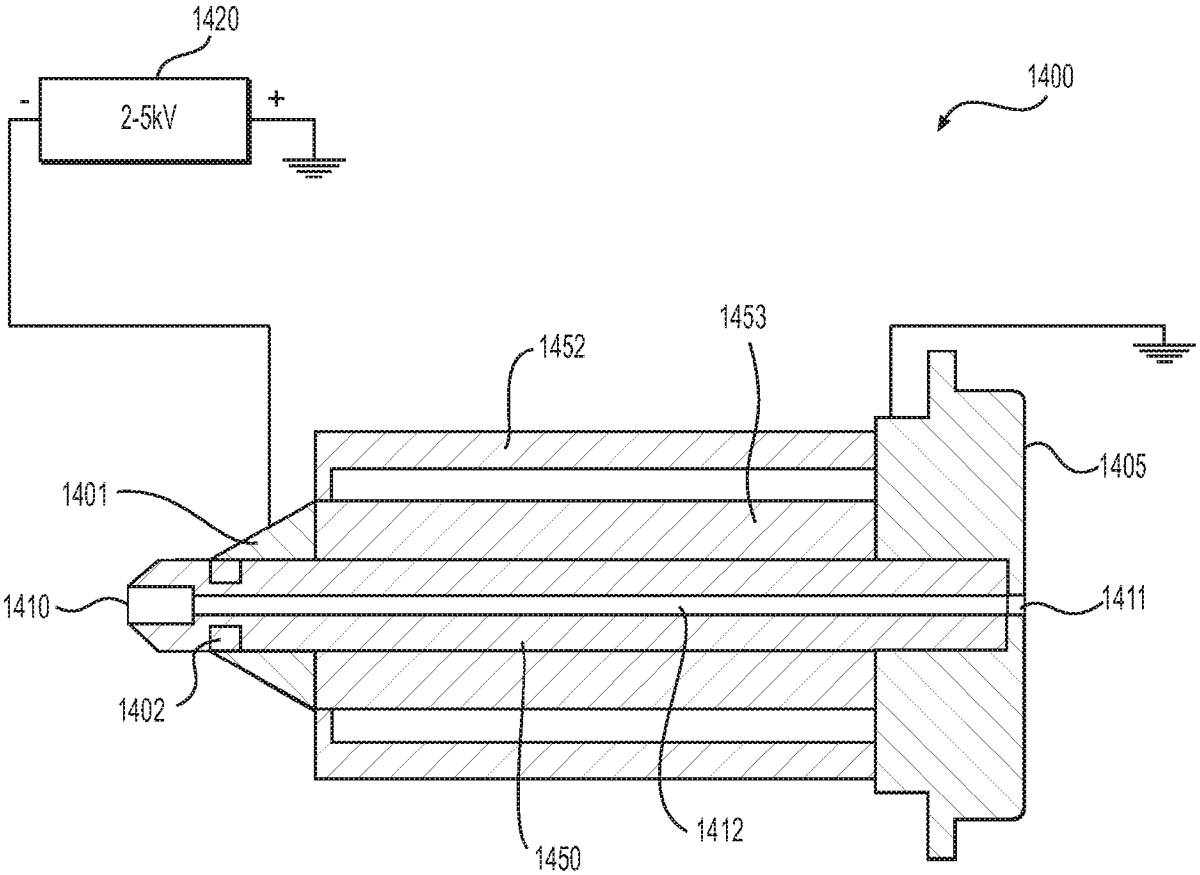
FIG. 14A is a schematic diagram of another embodiment of an electrospray interface.
Figure 14B:
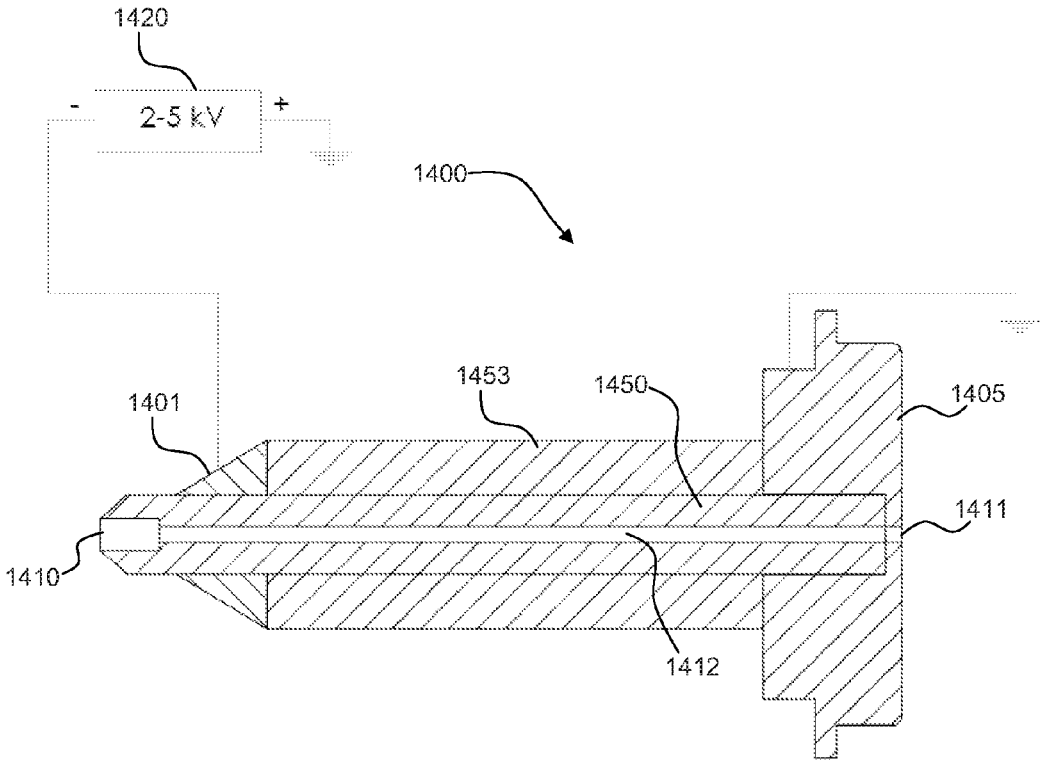
FIG. 14B is a schematic diagram of another embodiment of an electrospray interface.

FIGS. 14A and 14B are schematic diagrams of other embodiments of an electrospray interface. These embodiments are generally similar to the embodiment of FIG. 13. For example, electrospray interface 1400 has an inner ceramic tube 1450 that projects into the atmosphere beyond front cone 1401. This embodiment allows the front end of the inner ceramic tube 1450 to sample the droplets, clusters and ions in the electrospray directly. However, these embodiments do not include the network of resistors for applying the high voltage from minus 2-5 kV power supply 1420 to the inner ceramic tube and it does not have multiple electrodes embedded in or encircling the inner ceramic tube shown in FIG. 13. Instead, the minus 2-5 kV voltage is applied to stainless steel front cone 1401 and, in the embodiment shown in FIG. 14A, to the front electrode 1402, while end piece 1405 is held at or near ground.

In the embodiments of FIGS. 14A and 14B, charged particles enter entrance orifice 1410 and travel through inner bore 1412 and exit via exit orifice 1411. Inner ceramic tube 1450 is made of a material similar to the first ceramic material described above, such as zirconia, a zirconia-yttria blend or another zirconia blend having high resistivity and high thermal conductivity. Inner tube 1450 is held within intermediate ceramic tube 1453, which is made of a material similar to the second ceramic material described above, such as AlN (aluminum nitride) or Shapal Hi-M soft. Outer tube 1452 may be made from a material such as porcelain or glass, and can include a protective cover 1452 to the assembly, e.g., as shown in FIG. 14A. In other embodiments, the protective cover 1452 can be omitted, e.g., as shown in FIG. 14B.

Figure 15:
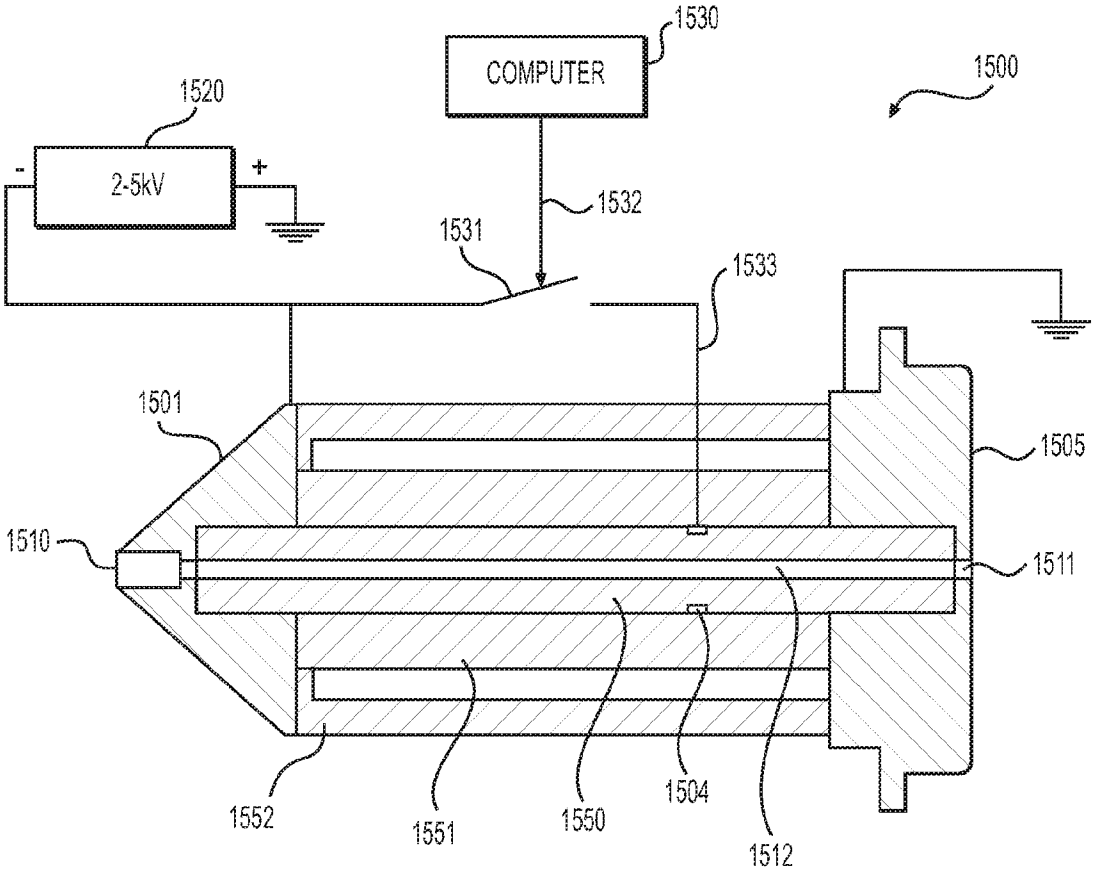
FIG. 15 is a schematic diagram of another embodiment of an electrospray interface.

FIG. 15 is a schematic diagram of another embodiment of an electrospray interface. This embodiment is generally similar to the embodiment of FIG. 12, except that it has (1) a single intermediate ceramic tube 1551; (2) a single ring electrode 1504 encircling inner ceramic tube 1550 at a point between entrance orifice 1510 and exit orifice 1511, and (3) a computer-controlled switch 1531 in communication on one side with computer 1530 via wired or wireless connection 1532, and on the other side with electrode 1504 via line 1533.

As in the FIG. 12 embodiment, electrospray interface 1500 has an outer tube 1552 which may be made of an electrically and thermally insulating material such as glass or porcelain. Inner ceramic tube 1550 may be made of zirconia, a zirconia-yttria blend, or another zirconia blend or of a ceramic material similar to and having the electrical and thermal properties of the first ceramic material described above. Intermediate ceramic tube 1551 may be made of AlN (aluminum nitride), Shapal Hi-M soft or another material similar to and having the same electrical and thermal properties as the second ceramic material described above.

In operation, when computer-controlled switch 1531 is open, the voltage from minus 2-5 kV power supply 1520 is applied across inner ceramic tube 1550 from front cone 1501 to end piece 1505. Thus, when the switch is open, charged particles are entrained through inner bore 1512 by the flow of gas from the atmosphere into the first stage of a mass spectrometer, as described above with reference to FIGS. 1 and 2.

When switch 1531 is closed, the minus 2-5 kV potential is applied directly to electrode 1504, such that the potential gradient between electrode 1504 and end piece 1505 is very steep. In this case, the opposing force due to the strong electric field between electrode 1504 and end piece 1505 may be strong enough to prevent any of the charged particles from continuing through inner bore 1512. Thus, the charged particles remain stored within inner bore 1512 until switch 1531 is opened. When switch 1531 is opened, typically after 1-20 milliseconds, the stored ions can continue through inner bore 1512 to exit via exit orifice 1511 into the first stage of a mass spectrometer system.

This embodiment may be used when the downstream processing of the ions in the mass spectrometer takes some time. It allows a first batch of ions to be processed by the mass spectrometer system while a second batch is collected. The second batch can then be released into the mass spectrometer system by opening switch 1531. Subsequent batches of ions may also be trapped and then released sequentially.

Figure 16:
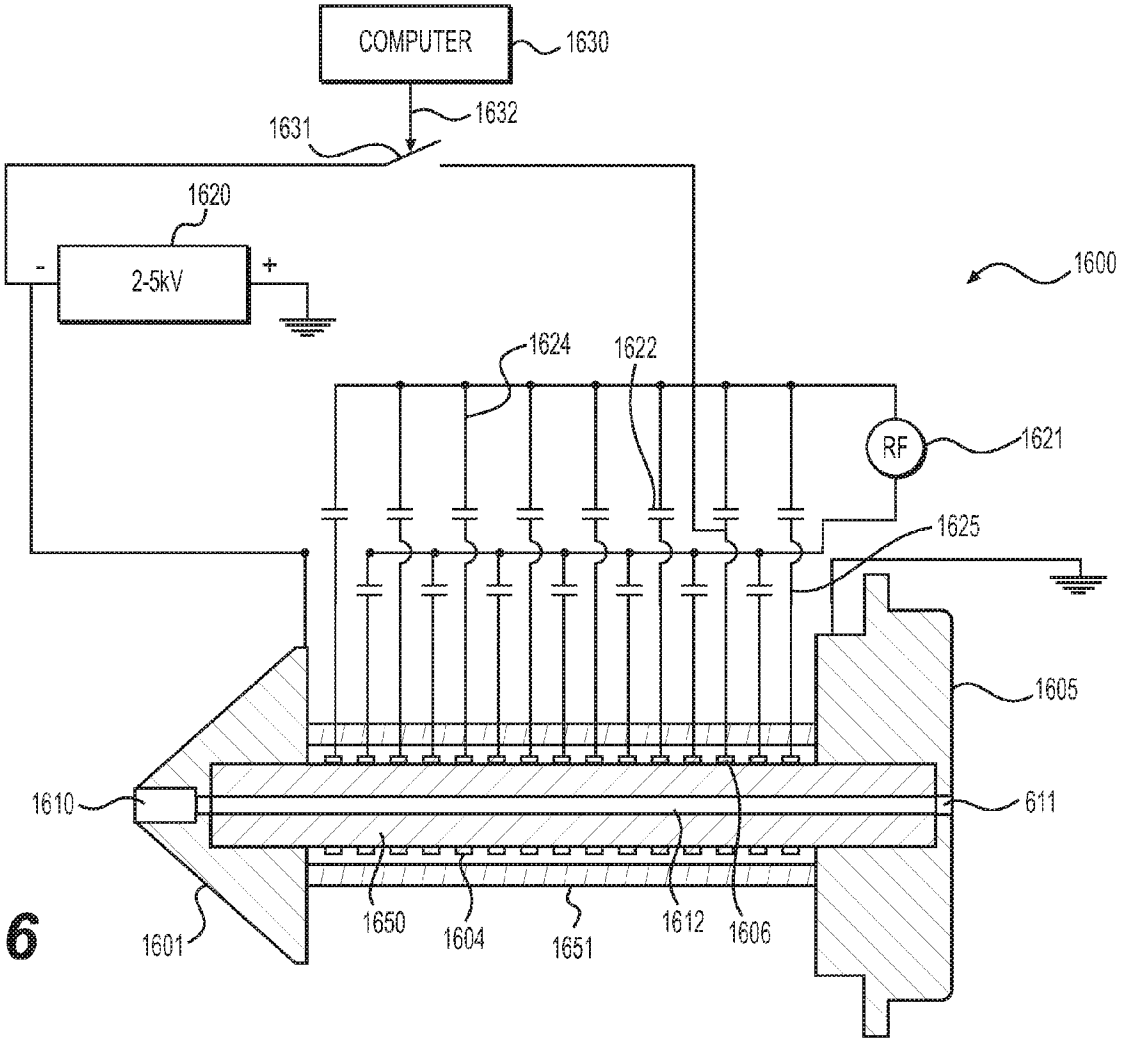
FIG. 16 is a schematic diagram of another embodiment of an electrospray interface.

FIG. 16 is a schematic diagram of another embodiment of the electrospray interface. Electrospray interface 1600 uses a computer-controlled switch 1631 to temporarily store ions in an inner ceramic tube. This embodiment is generally similar to the embodiment of FIG. 15, but includes ring electrodes 1604 encircling inner ceramic tube 1650, and RF source 1621 providing an RF signal to ring electrodes 1604 via capacitors 1622 and electrical connections 1624 and 1625.

Computer-controlled switch 1631 is connected to ring electrode 1606, which is one of the ring electrodes 1604 that encircle inner ceramic tube 1650. When computer-controlled switch is open, the minus 2-5 kV is applied to inner ceramic tube 1650 across from its front end at front cone 1601 to at or near ground at end piece 1605. With computer-controlled switch open, the ions travel through inner bore 1612 and out into the first stage of the mass spectrometer via exit orifice 1611. When computer-controlled switch 1631 is closed, the minus 2-5 kV potential is applied directly to ring electrode 1606. In that case, the potential gradient between ring electrode 1606 and end piece 1605 is very steep, such that there is a strong electric field opposing the motion of ions through the end of inner bore 1612. The ions thus become trapped within inner bore 1612, until computer-controlled switch 1631 is opened to allow the ions to travel through exit orifice 1611.

Front cone 1601, ring electrodes 1604 and end piece 1605 may be fabricated from an electrically conductive, corrosion resistant material such as stainless steel. Inner ceramic tube 1650 may be fabricated from a material similar to the first ceramic material described above, such as zirconia, an yttria-zirconia blend or other zirconia blends. Outer ceramic tube 1651 may be fabricated from a material similar to the second ceramic material described above, such as AlN (aluminum nitride) or Shapal Hi-M soft. The RF fields generated within inner bore 1612 assist in guiding ions and other charged particles through inner bore 1612 by reducing the collisions of these ions and particles with the wall of inner bore 1612, thus increasing the number of ions that emerge from inner bore 1612 via exit orifice 1611.

Figure 17:
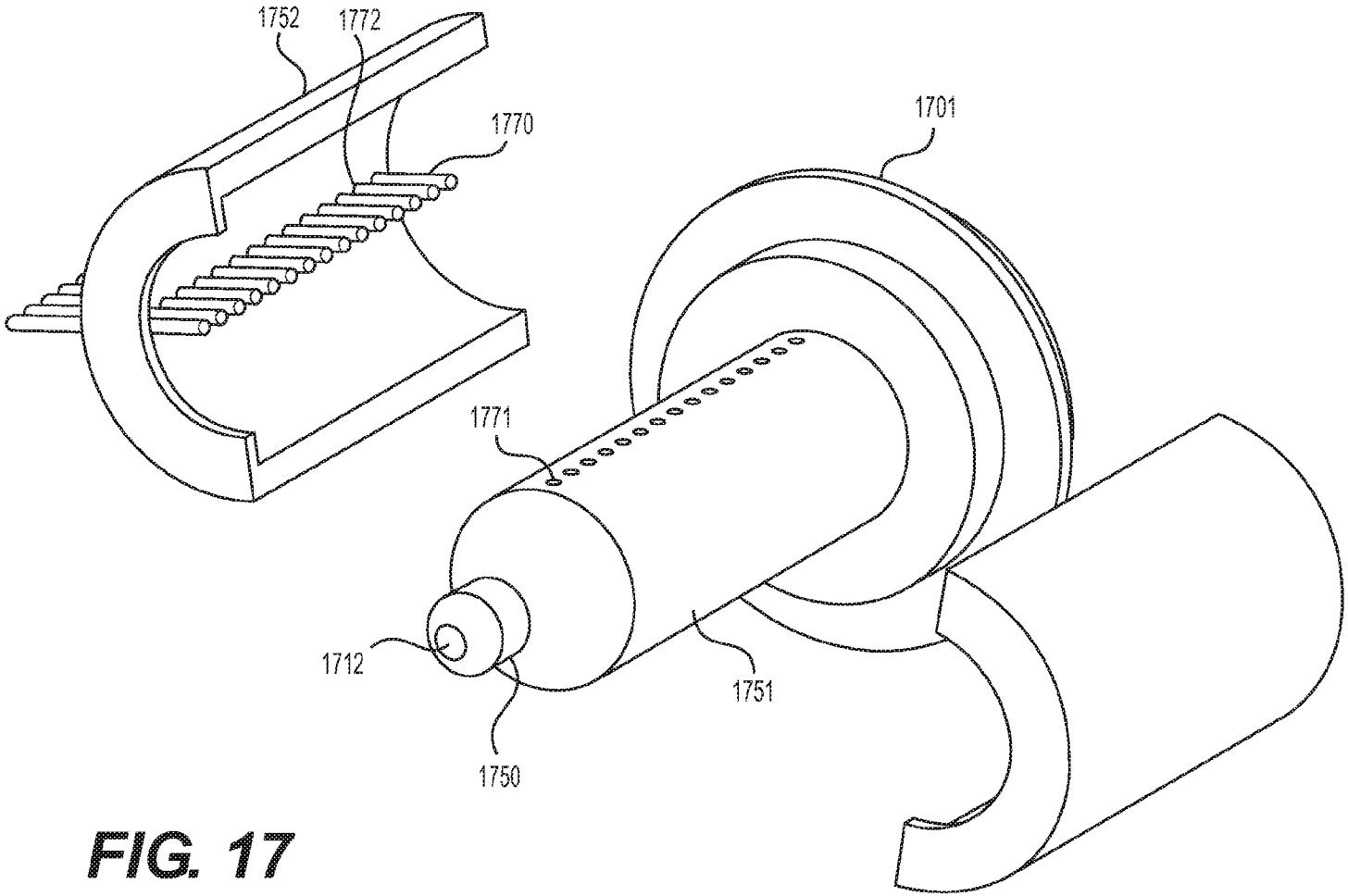
FIG. 17 is an exploded view showing the electrical connectors that are used to electrically connect the power supplies to the metal electrodes through an outer shield and through an intermediate ceramic tube.

FIG. 17 is a schematic diagram showing how electrical connections such as electrical connections 525 in FIG. 5B, 625 in FIG. 6, 725 in FIG. 7, 825 in FIG. 8, 925 in FIG. 9, 1025 in FIG. 10, 1125 in FIG. 11, 1325 in FIG. 13, 1533 in FIG. 15 and 1625 in FIG. 16 are made through an outer shield 1752 and an intermediate ceramic tube 1751 to electrodes embedded in or encircling ceramic inner tube 1750. Electrical connections 1770 pass through holes 1772 in protective shield 1752 and then pass through holes 1771 in intermediate ceramic tube 1751. Within intermediate ceramic tube 1751, electrical connections 1770 are connected to conductive components such as washers 502 in FIG. 5B, ring electrodes 604 in FIG. 6, embedded electrodes 704 in FIG. 7, ring electrodes 804 in FIG. 8, ring electrodes 904 in FIG. 9, ring electrodes 1004 in FIG. 10, ring electrodes 1104 in FIG. 11, embedded electrodes 1304 in FIG. 13, embedded electrode 1504 in FIG. 15 and ring electrodes 1604 in FIG. 16.

Figure 18A:
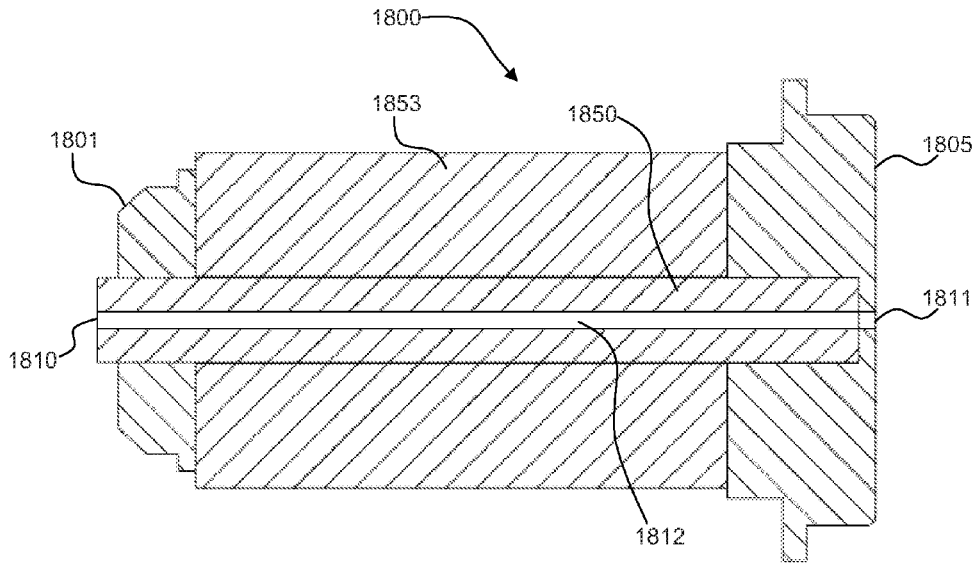
FIG. 18A is a schematic diagram of another embodiment of an electrospray interface.
Figure 18B:
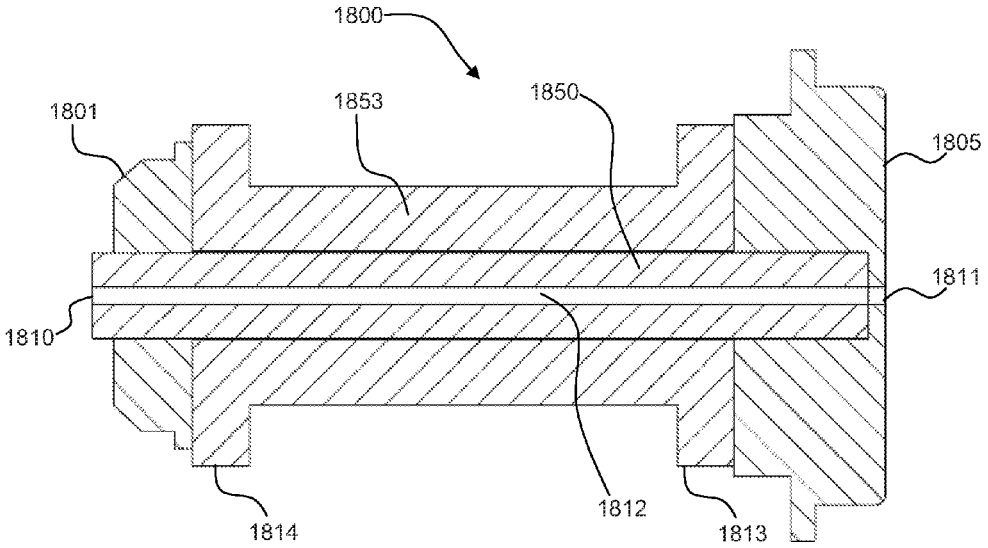
FIG. 18B is a schematic diagram of another embodiment of an electrospray interface.

FIGS. 18A and 18B are schematic diagrams showing other embodiments of an electrospray interface. These embodiments are generally similar to the embodiment of FIGS. 13, 14A and 14B. For example, electrospray interface 1800 has an inner ceramic tube 1850 that projects into the atmosphere beyond front piece 1801. This embodiment allows the front end of the inner ceramic tube 1850 to sample the droplets, clusters and ions in the electrospray directly. In the embodiments of FIGS. 18A and 18B, the voltage from the power supply is applied to the front piece 1801 while end piece 1805 is held at or near ground. The front piece 1801 can be a truncated cone thereby providing a flat end surface near the end surface of the inner ceramic tube 1850.

In the example shown in FIG. 18B, second ceramic tube 1853 has large diameter disks 1813 and 1814 at its ends, such that, together, second ceramic tube 1853 and disks 1813 and 1814 form a bobbin around which a heater coil may be wound. However, a heater coil may be wound around second ceramic tube 1853 without disks 1813 and 1814.

In these embodiments, charged particles enter entrance orifice 1810 and travel through inner bore 1812 and exit via exit orifice 1811. Inner ceramic tube 1850 is made of a material similar to the first ceramic material described above, such as zirconia, a zirconia-yttria blend or another zirconia blend having high resistivity and high thermal conductivity. Inner tube 1850 is held within intermediate ceramic tube 1853, which is made of a material similar to the second ceramic material described above, such as AlN (aluminum nitride) or Shapal Hi-M soft. An optional protective outer tube can be added to the embodiments of FIGS. 18A and 18B, e.g. as shown in FIG. 14A.

Figure 19A:
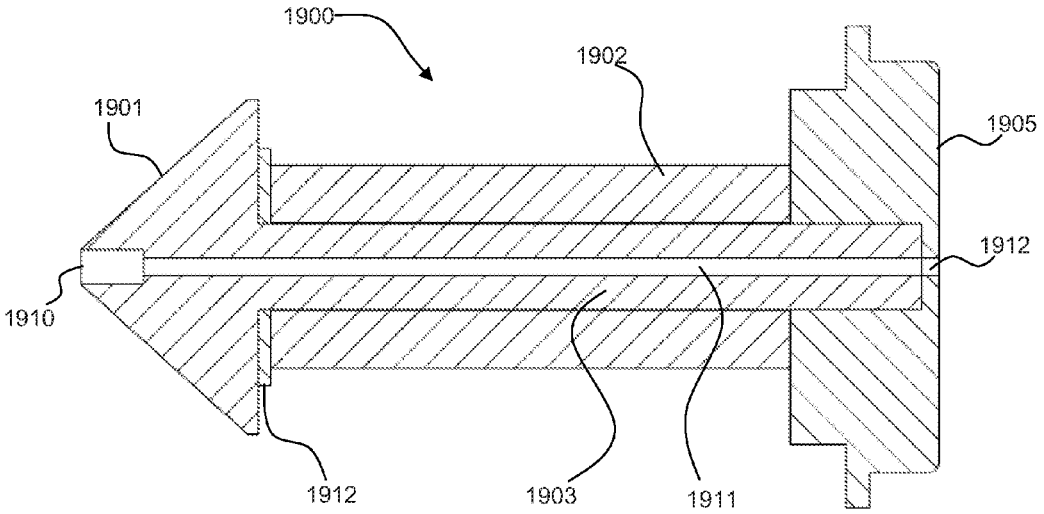
FIG. 19A is a schematic diagram of another embodiment of an electrospray interface.
Figure 19B:
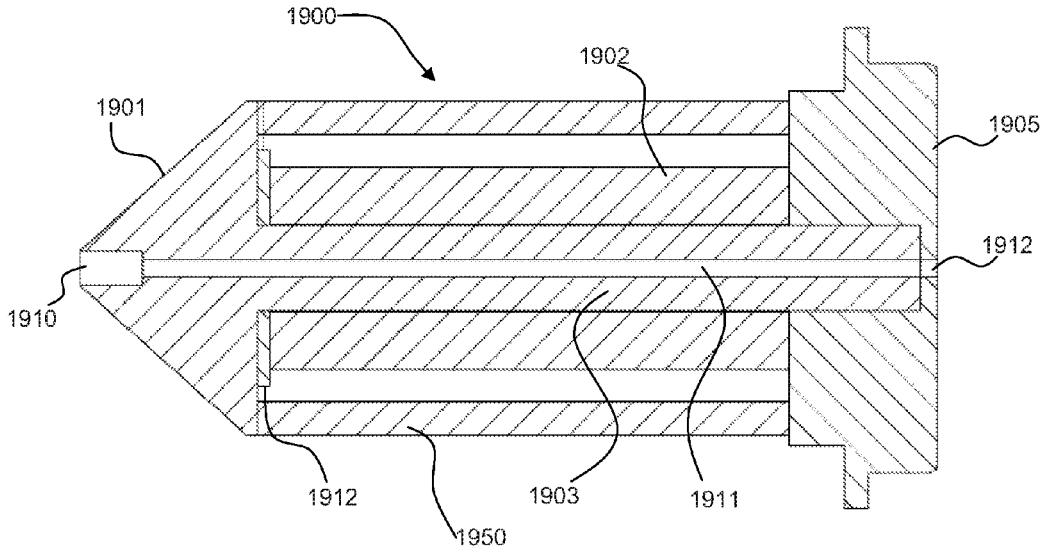
FIG. 19B is a schematic diagram of another embodiment of an electrospray interface.
Figure 19C:
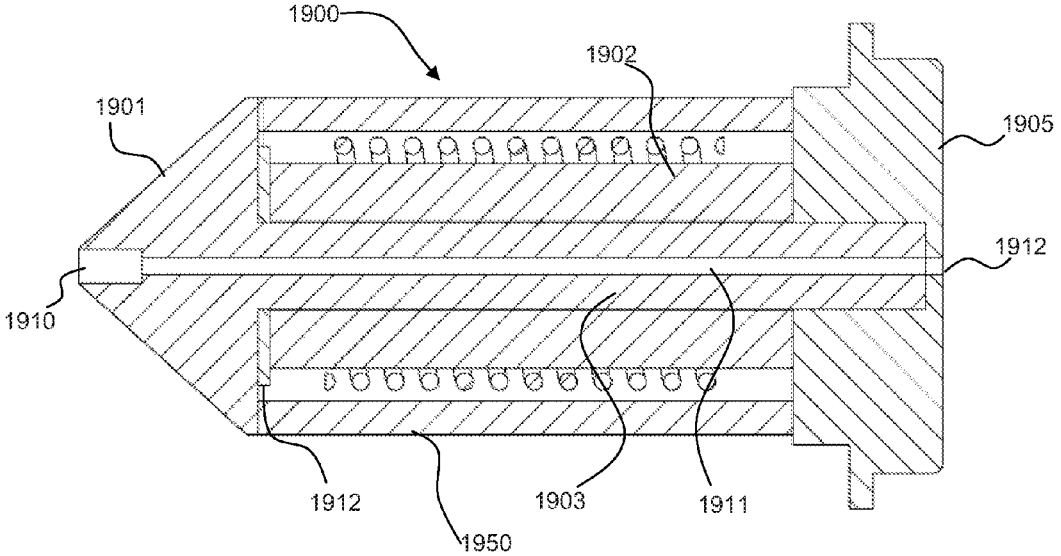
FIG. 19C is a schematic diagram of another embodiment of an electrospray interface.

FIGS. 19A, 19B, and 19C are cross-sections of other embodiments of electrospray interfaces to a mass spectrometer. In the embodiment shown in FIGS. 19A, 19B and 19C, electrospray interface 1900 has a first ceramic tube 1903 that includes a front piece 1901 that has an entrance orifice 1910 positioned to receive charged particles flowing from an electrospray nebulizer. The first ceramic tube 1903 has an inner bore 1911 extending from orifice 1910 to and through end piece 1905 to exit orifice 1912 in end piece 1905. The end piece 1905 may be fabricated from stainless steel or from other similarly electrically and thermally conductive and corrosion-resistant materials. The front cone 1901 is formed from the same material as the first ceramic tube 1903. For example, the front cone 1901 can be formed as part of the first ceramic tube 1903 or joined to the first ceramic tube 1903.

As shown in FIG. 19A, first ceramic tube 1903 extends between front cone 1901 and end piece 1905. First ceramic tube 1903 and front cone 1901 are fabricated from a first ceramic material. The first ceramic tube 1903 is held in the center of a second ceramic tube 1902 fabricated from a second ceramic material, as also shown in FIG. 19A. In some embodiments, a heater coil 1904 is wound around second ceramic tube 1902, e.g., as shown in FIG. 19C. Heater coil 1904 can be used to maintain inner bore 1911 at a temperature sufficient to desolvate the droplets and clusters entering front cone 1901 so that individual ions are produced exiting end piece 1905 through exit orifice 1912 for analysis by the mass spectrometer. The inner bore may be held at a temperature in the range of 65° C. to 225° C., for example in the range from 100° C. to 180° C.

In some embodiments, the second ceramic tube 1902 can have large diameter disks at its ends to form a bobbin around which heater coil 1904 may be wound. However, as shown in FIG. 19B, heater coil 1904 may be wound around second ceramic tube 1902 without such disks. Alternatively, heater coil could be wound around grooves in ceramic tube, e.g., as shown in FIG. 3C.

Second ceramic tube 1902 may also be fabricated with embedded heater elements, instead of having a separate heater coil wound around second ceramic tube. An example of such an embodiment is shown schematically in FIG. 3D. Optionally, in any of the embodiments described above, heater coil 1904 or heating element 1940 may be enclosed by a protective electrically and thermally insulating cylindrical cover 1950, as shown in FIG. 19D. For example, cylindrical cover 1950 may be a porcelain clamshell dimensioned to close over heater coil 1904 or over heating element 1940. In embodiments that do not include a heater coil or heating tube, heat can be transferred to the first ceramic tube 203 from the end piece 205 directly and/or through the second ceramic tube 202.

The embodiments illustrated in FIGS. 19A, 19B and 19C include a ring electrode 1912. In some embodiments, the ring electrode 1912 can be disposed between the first ceramic tube 1903 and the second ceramic tube 1902. For example, the ring electrode 1912 can be disposed between at a rear surface of the front cone 1901 of the first ceramic tube 1903. The ring electrode can be in the form of a flat washer having an outer diameter larger than the outer diameter of the second ceramic tube 1902 and an inner diameter substantially the same as the outer diameter of the first ceramic tube 1903 behind the front cone 1901. The ring electrode 1912 can be made of a conductive material, e.g., stainless steel. The high voltage potential from the power supply is applied to electrode 1912. End piece 1905 is held at or near ground.

Embodiments in which the electrical connection to the interface is made downstream from the entrance of the inner ceramic tube, e.g., as shown in FIGS. 14A, 14B, 18A, 18B, 18C, 19A, 19B, and 19C, provide numerous advantages. For example, such a configuration allows for the establishment of Poisseulle flow in the region of the inner bore of the inner tube that is upstream of the entrance to the inner bore before the charged droplets, clusters, and/or ions experience the electric field produced by the electrode or front piece. Other advantages include a reduction in the probability of destroying the electrospray tip due to an electrical arc between the front cone and other components. For example, it can be useful to adjust the distance between the electrospray interface and the nebulizer to optimize the ion signal. If the end of the electrospray interface gets too close to the nebulizer, an arc can occur between them, which can damage or destroy the nebulizer or the interface. An electrical connection made downstream of the entrance end of the inner bore of the inner tube provides an additional current limiting resistance down to the end of the inner tube, thus reducing the maximum possible discharge current that can flow through the arc and hence the arc's destructive potential. A further advantage includes a reduction in the magnitude of an electric shock that a user might experience if the interface is touched accidentally.

For a first ceramic material of suitable electrical resistivity, as described above, and very high thermal conductivity, the second ceramic tube 1902 in the embodiments shown in FIGS. 19A and 19B could be eliminated or formed from the first ceramic material as part of first ceramic tube 1902 and front cone 1901 as one structure. The very high thermal conductivity of the first ceramic material would ensure that it could be sufficiently heated by conduction of heat from end piece 1905 and would also reduce any thermal gradients along the length of first ceramic tube 1903.

The resistors in the resistive networks of the embodiments of FIGS. 5A, 5B, 6, 7, 8, 10 and 13 may all have the same value in order to distribute the high voltage potential evenly over the length of the inner ceramic tube. However, variable resistors or fixed resistors with differing values may be used to tailor the potential over the length of the inner tube.

The embodiments of FIG. 8, FIG. 9, FIG. 10 and/or FIG. 11 may also include an outer protective and insulating cover of porcelain or glass, such as those shown in FIGS. 6 and 7.

The schematic diagrams and the descriptions generally describe the front end of the electrospray interface as a cone. However, the front end of the interface may have other convex or concave shapes. The optimum shape may depend, for example, on the flow rate and the specific electrospray nebulizer used. For example, a cone shape may be well suited for a higher flow rate pneumatically assisted electrospray nebulizer, while a convex shape may be better suited for a low flow rate (1 ul/ml or less) nanoelectrospray nebulizer.

The schematic diagrams herein show the 2-5 KV power supply providing a high negative voltage to the front end of the electrospray interface. This configuration is used to attract positively-charged ions into the electrospray interface and thus supply a stream of positively-charged ions to the mass-analyzer. The same apparatus can be used to attract negatively-charged ions into the electrospray interface by providing a high positive voltage to the front end of the electrospray interface and supply a stream of negatively-charged ions to the mass analyzer.

For all configuration shown above, it is important that the thermal conductivities of both the first and second ceramic materials are sufficiently high for a given configuration such that they transmit sufficient heat from the heater to the inner bores to aid in desolvation of the electrospray and to prevent condensation of solvent vapors on the walls of the inner bores.

The various embodiments above have been described with an electrospray nebulizer at atmospheric pressure. Sometimes, it is useful to run an electrospray nebulizer at pressures above or below atmospheric pressure.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An interface comprising:

a front cone and an end piece;

a first ceramic tube having an inner bore extending from the front cone to the end piece, said inner bore comprising an entrance orifice and an exit orifice, and wherein the first ceramic tube is fabricated from a first ceramic material that is electrically resistive and thermally conductive; and a high voltage DC power supply electrically connected at a first polarity to the front cone and to a front electrode in electrical and thermal contact with the front cone, and at a second polarity to the end piece.

2. The interface of claim 1, wherein the first ceramic tube projects beyond the front cone into the atmosphere.

3. The interface of claim 1, wherein the first ceramic material is one of zirconia and a zirconia blend.

4. The interface of claim 1, wherein the first ceramic material is an yttria-zirconia blend.

5. The interface of claim 1, further comprising a second ceramic tube made of a second ceramic material surrounding the first ceramic tube and in thermal contact with the first ceramic tube, wherein at room temperature the second ceramic material has an electrical resistivity that is at least an order of magnitude higher than the electrical resistivity of the first ceramic material.

6. The interface of claim 1, further comprising an intermediate electrode positioned between the front cone and the end piece, wherein the intermediate electrode is connected to the first polarity of the DC voltage via a computer-controlled switch.

7. The interface of claim 5, wherein the second ceramic material is one of aluminum nitride and a composite material comprising aluminum nitride.

8. The interface of claim 1, further comprising a second ceramic tube surrounding the first ceramic tube, wherein the second ceramic tube is formed from the first ceramic material as part of the first ceramic tube and the front cone as one structure.

9. The interface of claim 1, wherein the inner bore extends from the entrance orifice to the exit orifice a distance within a range of about 1 cm to about 4 cm.

10. The interface of claim 1, wherein at room temperature the first ceramic material has an electrical resistivity above about $10^6$ Ω-cm and a thermal conductivity above about 2 W/m-K.

11. The interface of claim 5, wherein at room temperature the second ceramic material has an electrical resistivity above about $10^{12}$ Ω-cm and a thermal conductivity above about 70 W/m-K.

12. The interface of claim 8, wherein at room temperature the first ceramic material has an electrical resistivity above about $10^{6}$ Ω-cm and a thermal conductivity above about 2 W/m-K.

13. The interface of claim 8, wherein the first ceramic material has an electrical resistivity above about $10^{6}$ Ω-cm and a thermal conductivity above about 70 W/m-K.

14. The interface of claim 5, wherein the electrical resistivity of the second ceramic material is at least an order of magnitude higher than the electrical resistivity of the first ceramic material at temperatures that range from room temperature to 225° C.

15. The interface of claim 5, wherein the thermal conductivity of the second ceramic material is at least an order of magnitude higher than the thermal conductivity of the first ceramic material at temperatures that range from room temperature to 225° C.

* * * * *